US009274476B2

(12) United States Patent
Tomita

(10) Patent No.: US 9,274,476 B2
(45) Date of Patent: Mar. 1, 2016

(54) IMAGE FORMING APPARATUS, IMAGE FORMING SYSTEM, AND IMAGE FORMING METHOD

(71) Applicant: Sharp Kabushiki Kaisha, Osaka-shi, Osaka (JP)

(72) Inventor: Norio Tomita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/609,510

(22) Filed: Jan. 30, 2015

(65) Prior Publication Data

US 2015/0253710 A1 Sep. 10, 2015

(30) Foreign Application Priority Data

Mar. 4, 2014 (JP) ..... 2014-041458

(51) Int. Cl.
*G03G 15/36* (2006.01)
*G03G 15/00* (2006.01)
*G03G 15/041* (2006.01)

(52) U.S. Cl.
CPC ..... *G03G 15/50* (2013.01); *G03G 15/0415* (2013.01); *G03G 2215/00569* (2013.01)

(58) Field of Classification Search
CPC ..... G03G 15/50; G03G 15/5075; G03G 15/5087; G03G 15/011; G03G 15/041; G03G 15/0415
USPC ..... 399/86, 394, 401, 301; 347/116, 234, 347/248, 229
See application file for complete search history.

(56) References Cited

U.S. PATENT DOCUMENTS

| | | | | |
|---|---|---|---|---|
| 6,667,756 | B2 * | 12/2003 | Conrow et al. | 347/248 |
| 6,975,828 | B2 * | 12/2005 | Bessho et al. | 399/301 |
| 2007/0153077 | A1 | 7/2007 | Yamauchi et al. | |
| 2007/0201893 | A1 * | 8/2007 | Yamazaki | 399/82 |

FOREIGN PATENT DOCUMENTS

| | | | |
|---|---|---|---|
| JP | 2007-206667 A | | 8/2007 |
| JP | 2008-093911 A | * | 4/2008 |

* cited by examiner

*Primary Examiner* — Sophia S Chen
(74) *Attorney, Agent, or Firm* — Keating & Bennett, LLP

(57) ABSTRACT

An image forming apparatus that forms a first image in an image region of printing paper and forms a second image in a non-image region of the printing paper that is outside the image region includes an enlargement/reduction ratio specification unit that enables an enlargement/reduction ratio to be specified for the second image; and an image forming unit that forms the first image in the image region of the printing paper without enlarging/reducing the first image and forms the second image and the non-image region on the printing paper after enlarging/reducing the second image and the non-image region by the enlargement/reduction ratio specified through the enlargement/reduction ratio specification unit.

11 Claims, 12 Drawing Sheets

FIG.8(a)

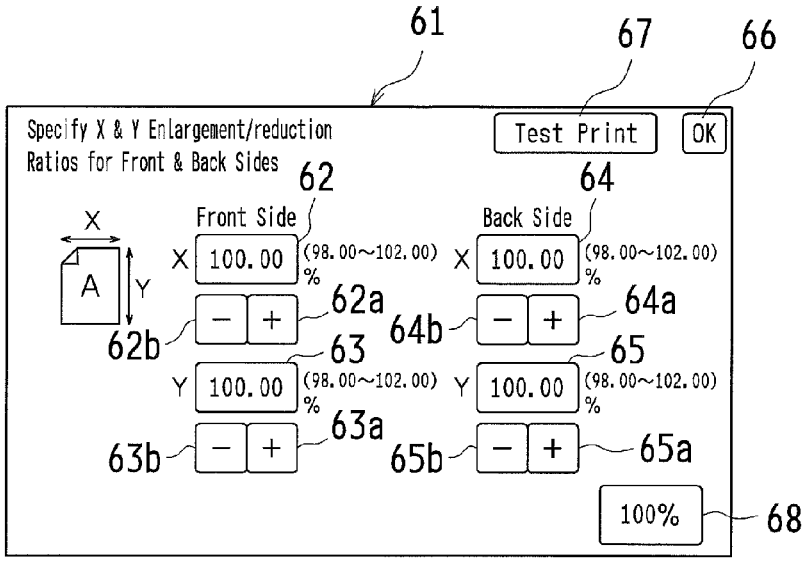

FIG.8(b)

| # | Name | Type | Option (Initial Value) | Description |
|---|---|---|---|---|
| 1 | Front Side, X | Text Box | 98.00 to 102.00%; Initial Value = 100.00% (Increments: 0.01%) | Adjustable by Pressing [+] or [-] |
| 2 | Front Side, Y | | | |
| 3 | Back Side, X | | | |
| 4 | Back Side, Y | | | |
| 5 | Test Print | Button | Not Applicable | Dialogue for Test Print is Displayed When Pressed |
| 6 | 100% | Button | Not Applicable | All X & Y Enlargement/reduction Ratios Restored to 100% When Pressed |
| 7 | OK | Button | Not Applicable | Set Variable to Current Specified Value and Return to Setup Screen |

FIG.9(a)

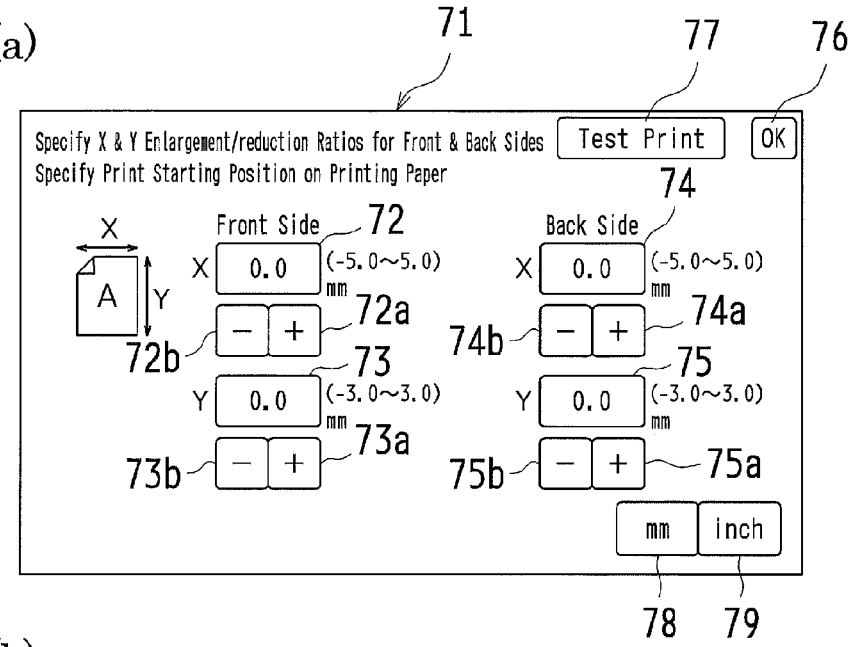

FIG.9(b)

| # | Name | Type | Option (Initial Value) | Description |
|---|---|---|---|---|
| 1 | Front Side, X | Text Box | ■Millimeters, -5.0~5.0mm Initial Value = 0.0 mm (Increments: 0.1 mm) | Adjustable by Pressing [+] or [-] |
| 2 | Front Side, Y | | ■Millimeters, -3.0~3.0mm Initial Value = 0.0 mm (Increments: 0.1 mm) | |
| 3 | Back Side, X | | ■Millimeters, -5.0~5.0mm Initial Value = 0.0 mm (Increments: 0.1 mm) | |
| 4 | Back Side, Y | | ■Millimeters, -3.0~3.0mm Initial Value = 0.0 mm (Increments: 0.1 mm) | |
| 5 | Test Print | Button | Not Applicable | Dialogue for Test Print is Displayed When Pressed |
| 6 | Units | Radio Button | mm | |
| 7 | OK | Button | Not Applicable | Set Variable to Current Specified Value and Return to Setup Screen |

IMAGE FORMING APPARATUS, IMAGE FORMING SYSTEM, AND IMAGE FORMING METHOD

CROSS-REFERENCE TO RELATED APPLICATIONS

This application claims priority on Japanese Patent Application, Tokugan, No. 2014-041458 filed Mar. 4, 2014 in Japan, the entire contents of which are hereby incorporated herein by reference.

BACKGROUND OF INVENTION

1. Technical Field of Invention

The present invention relates to image forming apparatuses, image forming systems, and image forming methods for forming images by printing them on printing paper.

2. Related Technology

An image forming apparatus of this kind forms an image first on the front side of printing paper and then on the back side of the same printing paper. During a process in which an image is formed on the front side of the printing paper, the printing paper could shrink or expand, leading to a deviation between the image forming position on the front side of the printing paper and the image forming position on the back side of the printing paper.

To address this potential issue, Japanese Patent Application Publication, Tokukai, No. 2007-206667 (hereinafter, "Patent Document 1") matches the image forming position on the front side of the printing paper with the image forming position on the back side of the printing paper through the following process. A reference mark is formed on the front side of the printing paper upon forming an image on the front side, and the position of the reference mark is detected twice, once before fixing and once after fixing. Subsequently, when an image is printed on the back side of the printing paper, the position and enlargement/reduction ratio are determined and specified for the image to be printed on the back side based on the deviation between the two detected positions of the reference mark, and the apparatus is set up accordingly. An image, enlarged/reduced (scaled up and/or scaled down) by the enlargement/reduction ratio, is then formed at the specified position on the back side of the printing paper.

Image quality could, however, suffer depending on the enlarging/reducing method being used. The quality of the image formed on the back side of the printing paper may fall if the image is enlarged/reduced when it is printed on the back side of the printing paper as in Patent Document 1.

Incidentally, a deviation between the image forming positions on the front and back sides of the printing paper is generally not a problem provided that the deviation is small in comparison to the image size. But, in cases where marks along which the printing paper is to be cut are formed on the front and back sides of the printing paper, a deviation in position of the cutting marks on the front and back sides of the printing paper is a problem: cutting the printing paper along those cutting marks formed on one side may leave uncut the cutting marks formed on the other side of the printing paper.

The present invention, conceived in view of these conventional problems, has an object to provide an image forming apparatus, an image forming system, and an image forming method that are capable of matching the positions of cutting marks and like indicators on the front and back sides of printing paper without sacrificing the quality of images formed on the printing paper.

SUMMARY OF INVENTION

To address the problems, an image forming apparatus in accordance with the present invention forms a first image in an image region of printing paper and forms a second image in a non-image region of the printing paper that is outside the image region, the image forming apparatus including: an enlargement/reduction ratio specification unit that enables an enlargement/reduction ratio to be specified for the second image; and an image forming unit that forms the first image in the image region of the printing paper without enlarging/reducing the first image and forms the second image and the non-image region on the printing paper after enlarging/reducing the second image and the non-image region by the enlargement/reduction ratio specified through the enlargement/reduction ratio specification unit.

This image forming apparatus in accordance with the present invention forms the first image in an image region of printing paper without enlarging/reducing the first image and forms the second image and the non-image region on the printing paper after enlarging/reducing (scaling up and/or scaling down) the second image and the non-image region by the enlargement/reduction ratio specified through the enlargement/reduction ratio specification unit. Therefore, the first image is not enlarged/reduced and retains its image quality. In addition, although the second image is enlarged/reduced and therefore may lose some of its image quality, the positional deviation and other defects of the second image on the printing paper are corrected because the second image is enlarged/reduced in such a manner as to match the shrinkage or expansion of the printing paper. For example, cutting marks and like indicators are generally formed in the non-image region; their image quality may not matter, but their positional deviation does. The image forming apparatus is capable of correcting the positional deviation of cutting marks and like indicators by handling the cutting marks and like indicators as the second image. To "enlarge/reduce" herein means upscaling and/or downscaling of an image by any enlargement/reduction ratio.

In the image forming apparatus in accordance with the present invention, the image forming unit may form the first image in an image region on a first side of the printing paper without enlarging/reducing the first image, form the second image and the non-image region on the first side after enlarging/reducing the second image and the non-image region by the enlargement/reduction ratio specified through the enlargement/reduction ratio specification unit, and form the first image and the second image respectively in an image region and a non-image region on a second side of the printing paper without enlarging/reducing the first image and the second image.

When the image forming apparatus is arranged in this manner, even if the printing paper shrinks or expands in the process in which an image is formed on the first side of the printing paper, the image forming apparatus is capable of correcting the positional deviation between the second image on the first side and the second image on the second side by enlarging/reducing the second image on the first side in such a manner as to match the shrinkage or expansion of the printing paper.

The image forming apparatus in accordance with the present invention may further include a position specification unit that enables a position on the printing paper to be specified for the first image or the second image, wherein the image forming unit forms the first image or the second image at the position specified through the position specification unit.

The image forming apparatus, when arranged in this manner, enables the position of the first image or the second image to be more accurately specified on the printing paper.

The image forming apparatus in accordance with the present invention may further include an operation unit that enables either a first mode in which the first image and the second image are enlarged/reduced or a second mode in which only the second image is enlarged/reduced to be selected, wherein if the first mode is selected through the operation unit, the image forming unit forms the first image and the second image on the printing paper after enlarging/reducing both the first image and the second image by the enlargement/reduction ratio specified through the enlargement/reduction ratio specification unit, and if the second mode is selected through the operation unit, the image forming unit forms the first image in the image region without enlarging/reducing the first image and forms the second image and the non-image region on the printing paper after enlarging/reducing the second image and the non-image region by the enlargement/reduction ratio specified through the enlargement/reduction ratio specification unit.

In the first mode, the first image and the second image are formed on the printing paper after both of them are enlarged/reduced. In the second mode, the first image is formed in the image region without being enlarged/reduced, and the second image is formed in the non-image region after being enlarged/reduced. By allowing selective use of the first mode and the second mode, the image forming apparatus is capable of efficiently adjusting the positions of the first image and the second image on the printing paper.

In the image forming apparatus in accordance with the present invention, the operation unit may include: an enlargement/reduction ratio input unit that enables an enlargement/reduction ratio to be specified for the first image or the second image and fed to the enlargement/reduction ratio specification unit; and a position input unit that enables a position to be specified for the first image or the second image.

By further including the enlargement/reduction ratio input unit and the position input unit, the image forming apparatus enables enlargement/reduction ratios and positions to be readily specified.

In the image forming apparatus in accordance with the present invention, the enlargement/reduction ratio specification unit may implement a computational process on image data representing the second image to change the enlargement/reduction ratio for the second image.

An image can be readily and inexpensively enlarged/reduced by implementing a computational process on image data. Although a computational process may not cause a positional deviation, it will likely entail low image quality. Meanwhile, cutting marks and like indicators may develop an undesirable positional deviation, but they may have low image quality without causing any problems. For these reasons, when cutting marks and like indicators are handled as the second image, it is preferable to implement a computational process on image data.

An image forming system in accordance with the present invention includes: a terminal device with a print driver; and an image forming apparatus connected to the terminal device over a network, wherein the print driver generates print data representing formation of a first image in an image region of printing paper and formation of a second image in a non-image region of the printing paper that is outside the image region after enlarging/reducing the second image and transmits the print data to the image forming apparatus over the network, and the image forming apparatus, upon receiving the print data, forms the first image in the image region of the printing paper without enlarging/reducing the first image according to the print data and forms the second image and the non-image region on the printing paper after enlarging/reducing the second image and the non-image region according to the print data.

An image forming method in accordance with the present invention forms a first image in an image region of printing paper and forms a second image in a non-image region of the printing paper that is outside the image region, said image forming method including: the enlargement/reduction ratio specification step of enabling an enlargement/reduction ratio to be specified for the second image; and the image forming step of forming the first image in the image region without enlarging/reducing the first image and forming the second image and the non-image region on the printing paper after enlarging/reducing the second image and the non-image region by the enlargement/reduction ratio specified in the enlargement/reduction ratio specification step.

These image forming system and method in accordance with the present invention achieve similar functions and effects to those achieved by the image forming apparatus in accordance with the present invention.

BRIEF DESCRIPTION OF DRAWINGS

FIG. 5(*b*) is an illustration representing a back side image formed on the back side of the recording paper after the paper has shrunk.

FIG. 6(*b*) is an illustration representing a back side image formed on the back side of the recording paper after the paper has shrunk.

FIG. 7(*b*) is an illustration representing the first mode selection box and a cancel button assigned for full selection mode displayed on the screen of the display unit.

FIG. 8(*a*) is an illustration representing an enlargement/reduction ratio input unit displayed on the screen of the display unit of the image forming apparatus shown in FIG. 1. FIG. 8(*b*) is a table showing functions of the enlargement/reduction ratio input unit in an organized manner.

FIG. 9(*a*) is an illustration representing a position input unit displayed on the screen of the display unit of the image forming apparatus shown in FIG. 1. FIG. 9(*b*) is a table showing functions of the position input unit in an organized manner.

DESCRIPTION OF EMBODIMENTS

The following will describe embodiments of the present invention in reference to drawings.

Figure 1:
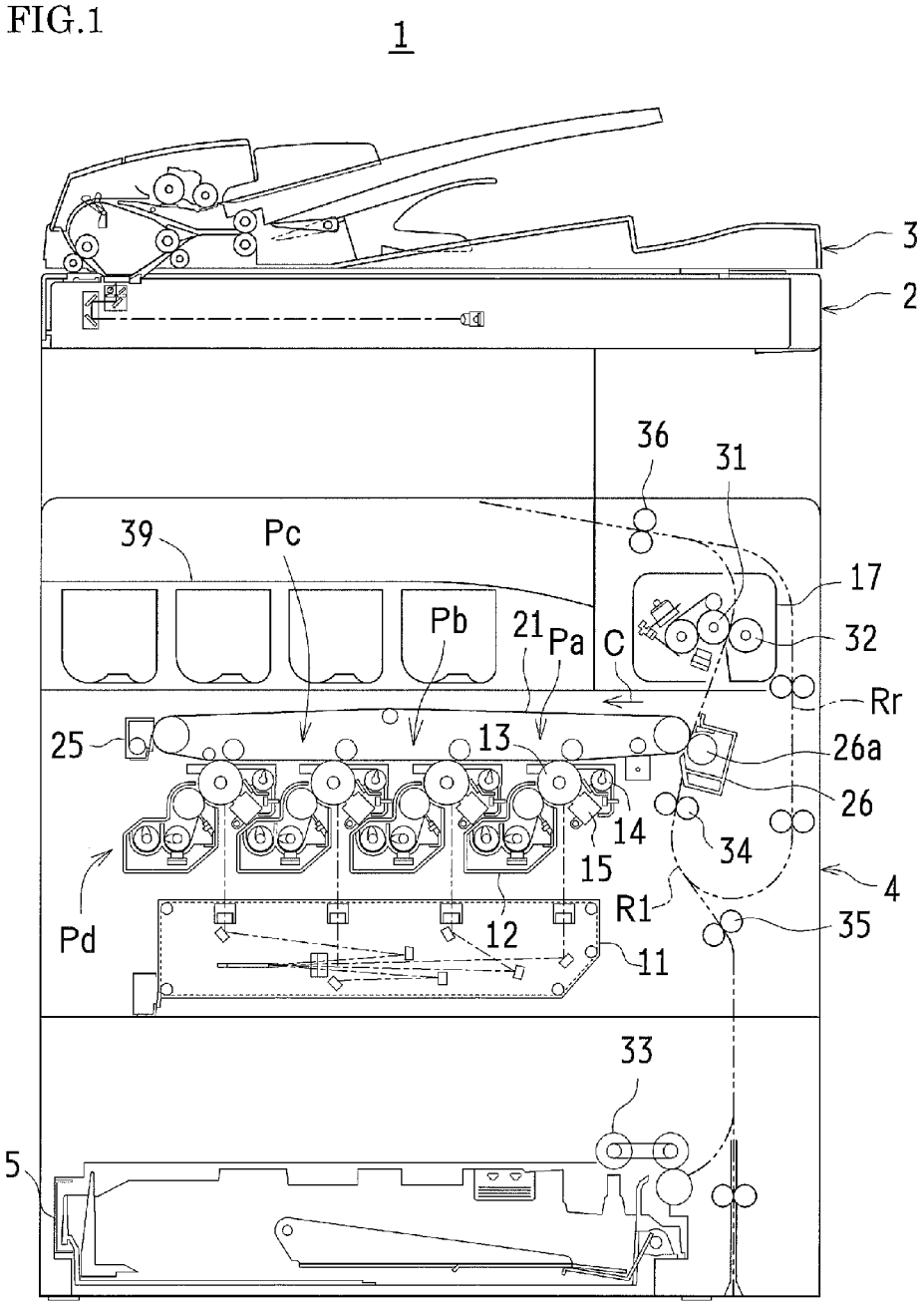
FIG. 1 is a cross-sectional view of an embodiment of the image forming apparatus in accordance with the present invention.

FIG. 1 is a cross-sectional view of an embodiment of the image forming apparatus in accordance with the present invention. The image forming apparatus 1 has a copying function whereby an original document is read and printed (reproduced) on recording paper. The image forming apparatus 1 includes, for example, an original reading device 2, an original transport device 3, a printing unit 4, and a paper feed cassette 5.

The image data that can be handled by the image forming apparatus 1 represents either a color image composed of black (K), cyan (C), magenta (M), and yellow (Y) or a monochrome image composed of a single color (e.g., black). Accordingly, the printing unit 4 includes four image stations Pa, Pb, Pc, and Pd, one for each color, to form four different toner images. Each of the black, cyan, magenta, and yellow image stations Pa, Pb, Pc, and Pd is provided with a developing device 12, a photosensitive drum 13, a drum cleaning device 14, and a charging device 15.

In each image station Pa, Pb, Pc, and Pd, the drum cleaning device 14 removes and collects residual toner from the surface of the photosensitive drum 13. After that, the charging device 15 charges the surface of the photosensitive drum 13 to a predetermined electric potential, and an optical scanning device 11 shines light onto the surface of the photosensitive drum 13 to form an electrostatic latent image on the surface. The developing device 12 then develops the electrostatic latent image on the surface of the photosensitive drum 13 to form a toner image on the surface of the photosensitive drum 13. Toner images of different colors are thus formed on the surfaces of the photosensitive drums 13.

Subsequently, a belt cleaning device 25 removes and collects residual toner from an intermediate transfer belt 21 while the intermediate transfer belt 21 is orbiting in the direction indicated by arrow C in FIG. 1. Thereafter, the toner images of different colors formed on the surfaces of the photosensitive drums 13 are sequentially transferred to and superimposed on the intermediate transfer belt 21 to form a color toner image on the intermediate transfer belt 21.

A nip area is formed between the intermediate transfer belt 21 and a secondary transfer roller 26*a* of a secondary transfer device 26. Recording paper transported via a printing paper transport path R1 is nipped in the nip area while it is being further transported. During that transport, the color toner image on the surface of the intermediate transfer belt 21 is transferred onto the recording paper. The recording paper is then heated and pressurized while being nipped between a heating roller 31 of a fixing device 17 and a pressure roller 32 to fix the color toner image on the recording paper.

The recording paper is drawn out of the paper feed cassette 5 by pickup rollers 33, transported via the printing paper transport path R1, and passed through the secondary transfer device 26 and the fixing device 17 before being ejected onto a discharge tray 39 via discharge rollers 36. The printing paper transport path R1 is provided with, for example, registration rollers 34, transport rollers 35, and discharge rollers 36. The registration rollers 34 temporarily stop the moving recording paper and properly position the leading edge of the recording paper before restarting the transport of the recording paper in synchronization with the transfer of the color toner image that occurs in the nip area between the intermediate transfer belt 21 and the secondary transfer roller 26*a*. The transport rollers 35 facilitate the transport of the recording paper.

When an image is to be formed not only on the front side of the recording paper, but also on the back side thereof, the recording paper is transported in an opposite direction from the discharge rollers 36 to a turn-over path Rr where it is turned over. The recording paper is then guided back to the registration rollers 34, has an image recorded and fixed on the back side thereof in a similar manner to the front side of the recording paper, and is ejected onto the discharge tray 39.

Figure 2:
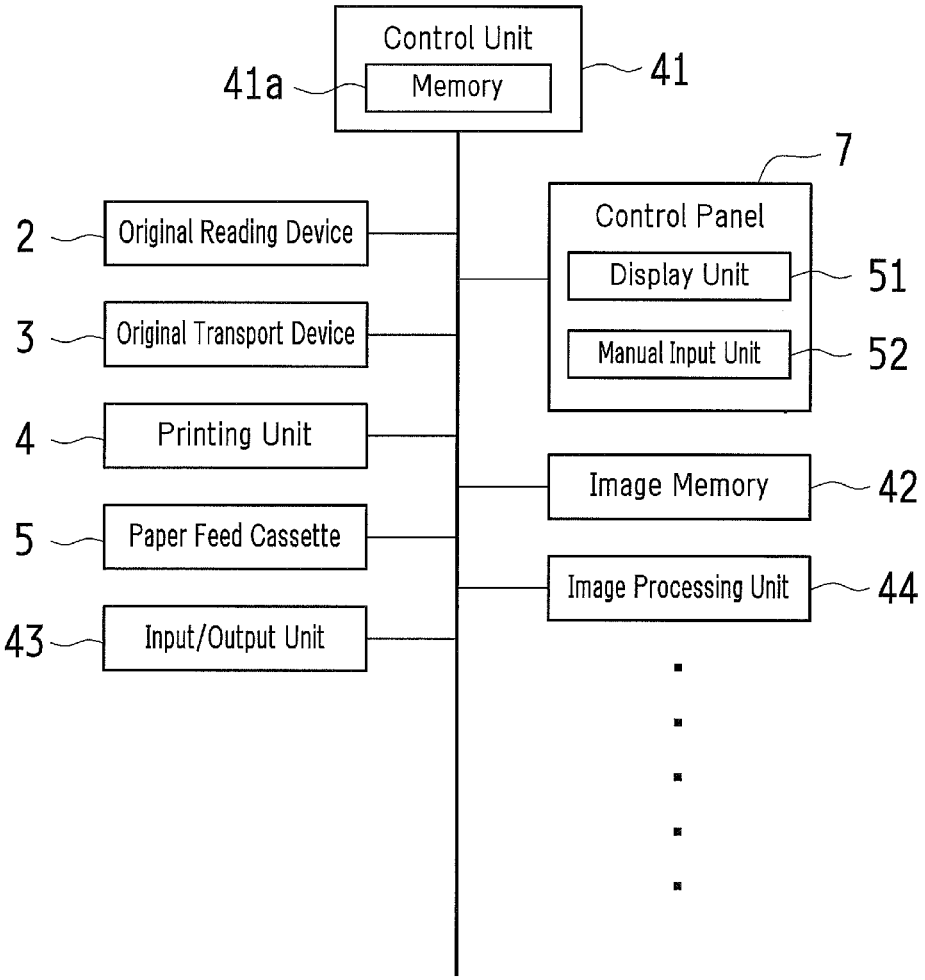
FIG. 2 is a block diagram of the configuration of a control system for the image forming apparatus shown in FIG. 1.

Next will be described the configuration of a control system for the image forming apparatus 1. FIG. 2 is a block diagram of the configuration of the control system for the image forming apparatus 1. As illustrated in FIG. 2, the control unit 41 exchanges control and other data with the original reading device 2, the original transport device 3, the printing unit 4, the paper feed cassette 5, a control panel 7, etc. to control them. The control unit 41 also selectively implements a printing function, a scanning function, and a copying function in response to manual operation of the control panel 7.

For example, upon receiving a command for a scanning function from the manually operated control panel 7, the control unit 41 controls the original reading device 2 to read an original document and output image data representing the image of the original document. Under the control of the control unit 41, the image data is processed by the image processing unit 44, and the processed image data is stored in an image memory 42. When an input/output unit 43 receives image data from an external terminal device (not shown), the image data is processed by the image processing unit 44, and the processed image data is stored in the image memory 42 under the control of the control unit 41. The control unit 41, upon receiving a printing function selecting command from the manually operated control panel 7, retrieves image data from the image memory 42 and instructs the printing unit 4 to print an image represented by the image data on recording paper.

Figure 3:
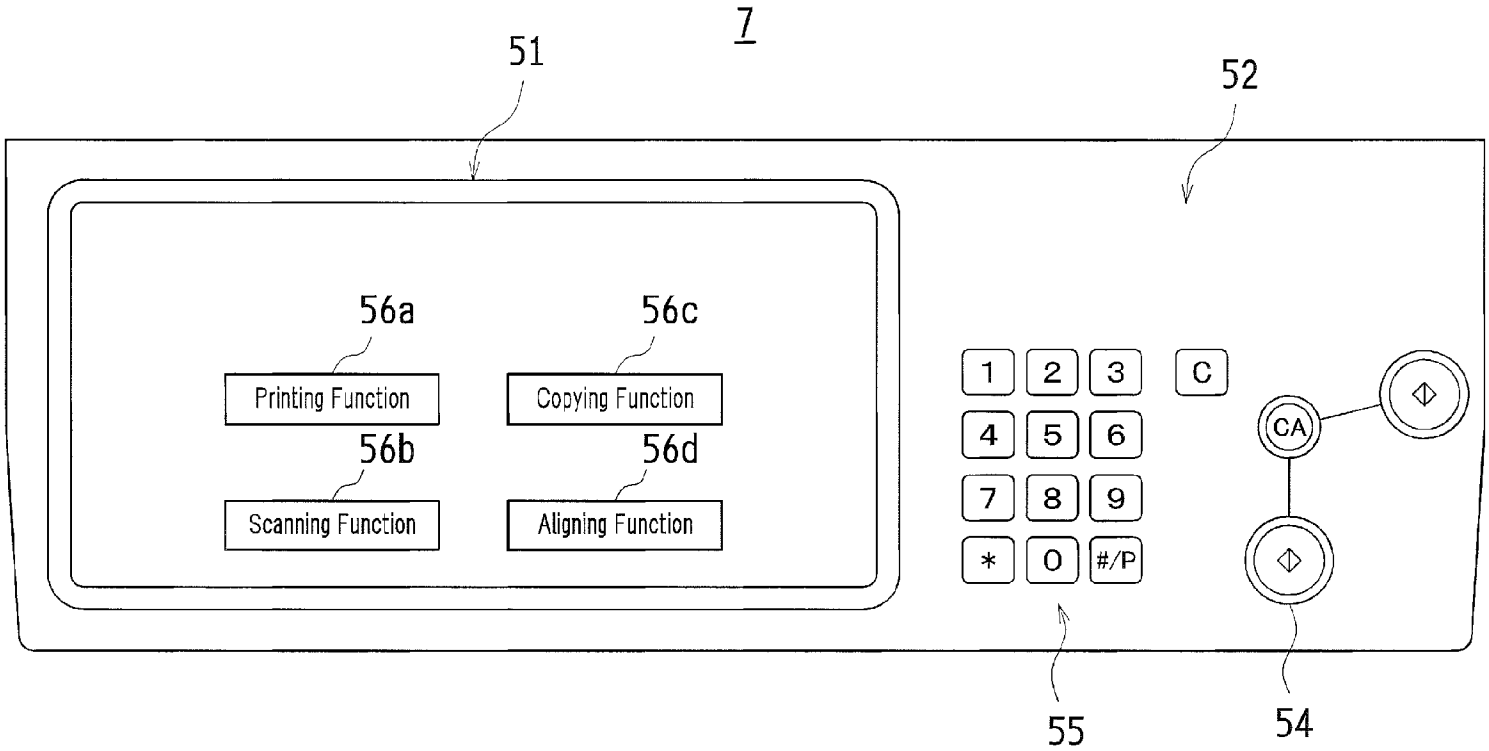
FIG. 3 is a plan view of a control panel for the image forming apparatus shown in FIG. 1.

FIG. 3 is a plan view of the control panel 7. As illustrated in FIG. 3, the control panel 7 includes a display unit 51 and a manual input unit 52. The manual input unit 52 has, for example, a start key 54, numeric keys 55, and a touch panel (placed on top of the screen of the display unit 51, but not shown). For example, when any of function selection boxes 56*a* to 56*d* is touched on the initial setup screen on the display unit 51, the touch panel detects which of the function selection boxes has been touched. The manual input unit 52 notifies the control unit 41 of the function selection box detected by the touch panel.

The image forming apparatus 1, arranged as above, is capable of, after forming an image on the front side of the recording paper, forming another image on the back side of the recording paper by transporting the recording paper in an opposite direction from the discharge rollers 36 to the turn-over path Rr, turning over the recording paper, and guiding the recording paper back to the registration rollers 34, as mentioned earlier.

However, during the process in which an image is formed on the front side of the recording paper, the recording paper shrinks as it is heated by the fixing device 17. Therefore, if an image is formed on the back side of the recording paper without adjusting the image enlargement/reduction ratio, etc., there may occur a deviation between the image forming position on the front side of the recording paper and the image forming position on the back side of the recording paper. For this reason, when an image is to be formed on the back side of the recording paper as well as on its front side, it is preferable to adjust the image enlargement/reduction ratio for both or one of the front and back sides of the recording paper and enlarge/reduce (scale up and/or scale down) one of the front and back side images by the adjusted enlargement/reduction ratio so as to match the image forming positions on the front and back sides of the recording paper. To "enlarge/reduce" herein means upscaling and/or downscaling of an image by any enlargement/reduction ratio.

An image can be enlarged/reduced readily and inexpensively through computational processing of image data. Computational processing of image data however will likely lead to low image quality even in the absence of positional deviation. An example of enlarging computational processing is linear interpolation in which supplementary pixels are added. An example of reducing computational processing is sampling in which some pixels are removed. Various other computational processing techniques are also proposed, but all of them end up with low image quality. Meanwhile, cutting marks and like indicators could lead to positional deviation problems, but do not entail low image quality problems. For example, when recording paper is to be cut along cutting marks formed beforehand on the front and back sides of the recording paper, the cutting marks, possibly having low image quality, are still recognizable. However, if the cutting marks are formed at different positions on the front and back sides of the recording paper, and the recording paper is cut along the cutting marks on either the front or back side of the recording paper, those cutting marks that are formed on the other side remain intact on the recording paper.

Main images (text, photographs, drawings, etc.) do not suffer from positional deviation problems because, even if the main images are printed on the recording paper at different positions on the front and back sides of the recording paper, the deviation is small in comparison to the image size.

First Embodiment

Accordingly, in the first embodiment, cutting marks and like indicators, which do not suffer from low image quality problems, are formed outside main images (text, photographs, drawings, etc.) which entail low image quality problems. In other words, a first image, including a main image, is formed in an image region, and a second image, including cutting marks and like indicators, are formed in a non-image region that is outside the image region. On at least the front side of recording paper, the image region (first image) is formed on the recording paper without being enlarged/reduced, and the non-image region (second image) is formed on the recording paper after being enlarged/reduced. Therefore, the first image is not enlarged/reduced, retaining its image quality. The second image is enlarged/reduced and may hence suffer from low image quality problems. Nevertheless, the positional deviation and other defects of the second image on the front side of the recording paper may be corrected by enlarging/reducing the second image in accordance with shrinkage of the recording paper so as to match the position of the second image (including cutting marks and like indicators) on the front side of the recording paper with the position of the second image on the back side of the recording paper.

Figure 4A:
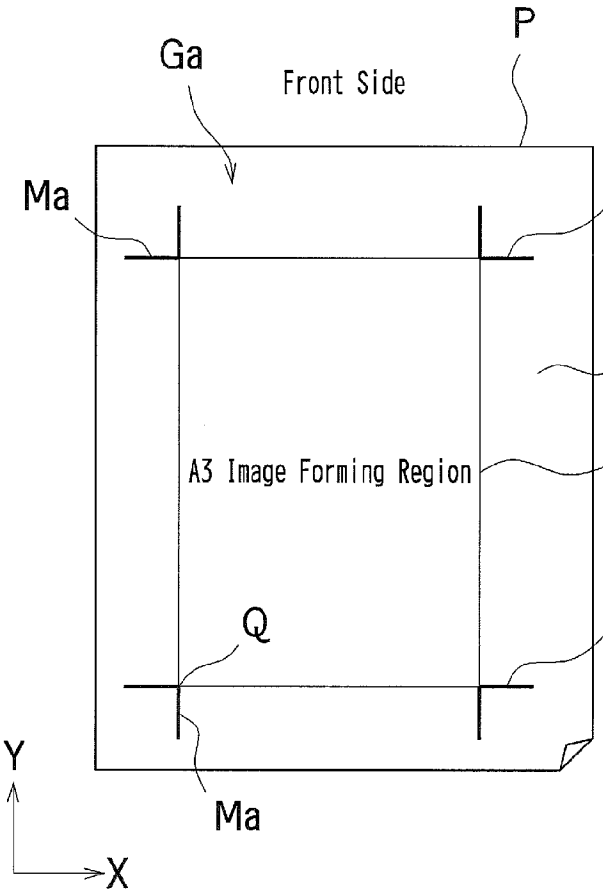
FIGS. 4(*a*) and 4(*b*) are illustrations representing exemplary front and back side images formed respectively on the front and back sides of recording paper in a first embodiment.
Figure 4B:
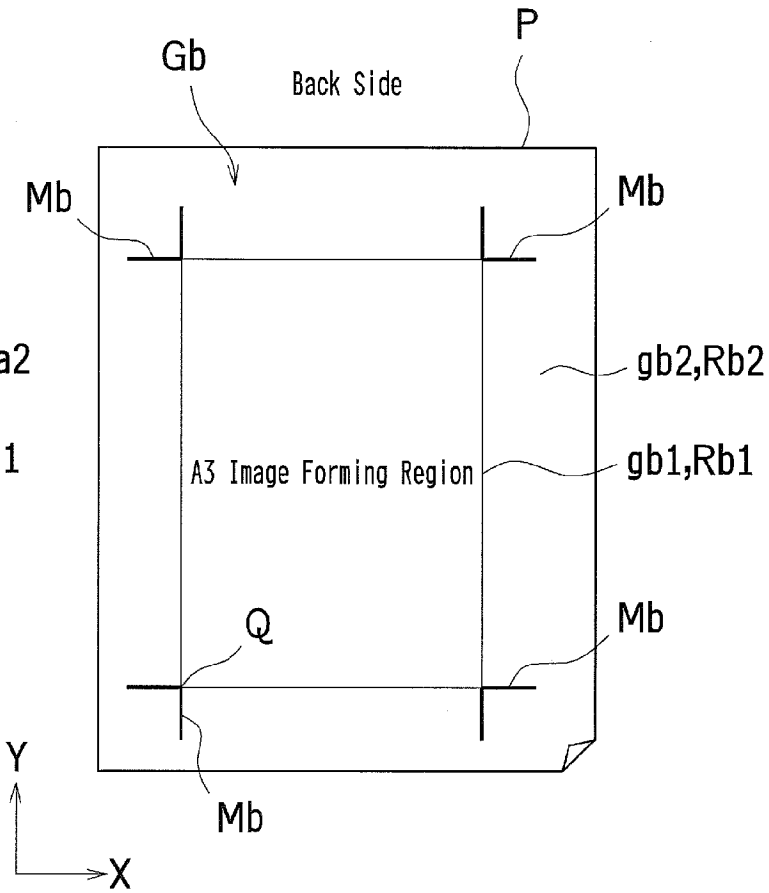

Next, concrete examples of the first and second images will be described. FIGS. 4(*a*) and 4(*b*) represent exemplary front and back side images Ga and Gb formed respectively on the front and back sides of the recording paper P. Note that direction X is taken along the lateral direction of the recording paper P and also that direction Y is taken along the longitudinal direction of the recording paper P.

Referring to FIGS. 4(*a*) and 4(*b*), the front side image Ga is composed of a first image (main image) ga1 and a second image ga2. The first image ga1 corresponds to a rectangular image region Ra1 including text, photographs, drawings, etc. and their backgrounds and margins. The second image ga2 corresponds to a frame-shaped non-image region Ra2 including cutting marks Ma and their backgrounds and margins. The non-image region Ra2 is located outside the image region Ra1. The cutting marks Ma are located at predetermined positions that are outside and relative to the rectangular image region Ra1. For example, the cutting marks Ma may be specified to be located outside the image region Ra1 and separated from the sides of the image region Ra1 by a particular distance. Alternatively, the cutting marks Ma may be specified to be located outside the image region Ra1 and separated from the corners of the image region Ra1 in longitudinal and lateral directions by a particular distance. The second image ga2 corresponds to the frame-shaped non-image region Ra2 including the cutting marks Ma and their backgrounds and margins; the non-image region Ra2 for this second image ga2 is located outside the image region Ra1 for the first image ga1.

Likewise, the back side image Gb is composed of a first image gb1 and a second image gb2. The first image gb1 corresponds to a rectangular image region Rb1 including text, photographs, drawings, etc. and their backgrounds and margins. Cutting marks Mb are specified to be located at predetermined positions that are outside the image region Rb1. A frame-shaped non-image region Rb2 (corresponding to the second image gb2) is specified to include the cutting marks Mb and their backgrounds and margin. The non-image region Rb2 is located outside the image region Rb1.

In this context, the first image ga1 (image region Ra1) for the front side image Ga and the first image gb1 (image region Rb1) for the back side image Gb have the same size and are located at the same positions on the front and back sides of the recording paper P. Likewise, the second image ga2 (non-image region Ra2) for the front side image Ga and the second image gb2 (non-image region Rb2) for the back side image Gb have the same size and are located at the same positions on the front and back sides of the recording paper P. Therefore, if the recording paper P does not shrink or expand at all during printing on the front side of the recording paper P, the first image ga1 (image region Ra1) and the first image gb1 (image region Rb1) for the back side image Gb are superimposed on the front and back sides of the recording paper P, and the second image ga2 (non-image region Ra2) and the second image gb2 (non-image region Rb2) are also superimposed on the front and back sides of the recording paper P.

On the other hand, if the front side image Ga is formed on the front side of the recording paper P, the recording paper P shrinks as it is heated by the fixing device 17 during the formation of the front side image Ga, and the back side image Gb is subsequently formed on the back side of the shrunk recording paper P, the front and back side images Ga and Gb appear like those shown in FIGS. 5(*a*) and 5(*b*). A comparison of FIGS. 5(*a*) and 5(*b*) clearly indicates that because the front side image Ga also shrinks due to the shrinkage of the recording paper P, there occurs a deviation between the first image ga1 for the front side image Ga and the first image gb1 for the back side image Gb and also between the second image ga2 for the front side image Ga and the second image gb2 for the back side image Gb, and the front side image Ga is smaller than the back side image Gb. As a result, there occurs a deviation between the cutting marks Ma, which are a part of the second image ga2 for the front side image Ga, and the cutting marks Mb, which are a part of the second image gb2 for the back side image Gb.

Accordingly, when the front side image Ga is to be formed on the front side of the recording paper P, only the second image ga2 (non-image region Ra2) for the front side image Ga is enlarged by a suitable enlargement/reduction ratio before being printed. Subsequent to the printing of the second image ga2, the back side image Gb is formed on the back side of the shrunk recording paper P without being enlarged/reduced. As a result, the front and back side images Ga and Gb appear like those shown in FIGS. 6(*a*) and 6(*b*). A comparison of FIGS. 6(*a*) and 6(*b*) clearly indicates that because only the second image ga2 (non-image region Ra2) for the front side image Ga is enlarged by a suitable enlargement/reduction ratio, when the front side image Ga has shrunk due to the shrinkage of the recording paper P, the second image ga2 (non-image region Ra2) for the front side image Ga and the second image gb2 (non-image region Rb2) for the back side image Gb have the same size, and the cutting marks Ma, which are a part of the second image ga2, and the cutting marks Mb, which are a part of the second image gb2, are substantially superimposed on the front and back sides of the recording paper P. In addition, because the image region Ra1 for the front side image Ga is not enlarged/reduced, the first image (text, photographs, drawings, etc.) ga1 retains its image quality.

The front and back side images Ga and Gb are formed respectively on the front and back sides of the recording paper P by using a lower left reference position Q as a reference. In addition, the cutting marks Ma, which are a part of the second image ga2, and the cutting marks Mb, which are a part of the second image gb2, are also substantially superimposed if only the second image gb2 (non-image region Rb2) for the back side image Gb is reduced by a suitable enlargement/reduction ratio instead of the second image ga2 (non-image region Ra2) for the front side image Ga alone being enlarged. When only the second image gb2 for the back side image Gb is reduced, however, the second image gb2 may interfere with the first image gb1. Therefore, only the second image ga2 for the front side image Ga is enlarged.

Next will be described a configuration and process by which the first image ga1 for the front side image Ga detailed above is formed in the image region Ra1 of the recording paper P without being enlarged/reduced and the second image ga2 for the front side image Ga is formed in the non-image region Ra2 after being enlarged/reduced.

Assume that the image memory 42 has stored therein front side image data Da representing the front side image Ga shown in FIG. 4(*a*) and back side image data Db representing the back side image Gb shown in FIG. 4(*b*). Both the front and back side images Ga and Gb are larger than standard paper size A3, and both the first image ga1 for the front side image Ga and the first image gb1 for the back side image Gb are of standard paper size A3. The recording paper P, the front side image Ga, and the back side image Gb may have other dimensions.

Figure 7A:
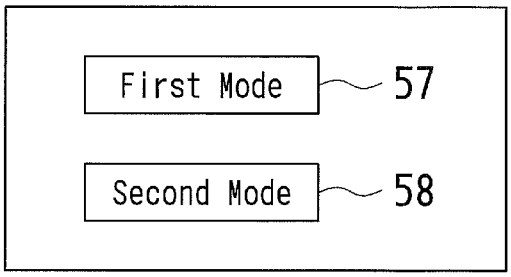
FIG. 7(*a*) is an illustration representing a first mode selection box assigned for full selection mode and a second mode selection box assigned for partial application mode displayed on a screen of a display unit of the image forming apparatus shown in FIG. 1.
Figure 7B:
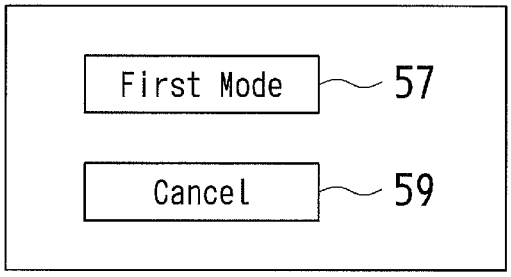

When the user touches, on the initial setup screen on the display unit 51 of the control panel 7 shown in FIG. 3, the function selection box 56*d* assigned for an aligning function for the front and back side images Ga and Gb, a list (not shown) of image data stored in the image memory 42 is displayed on the screen of the display unit 51. The user then selects by touching from the list the front and back side image data Da and Db representing respectively the front and back side images Ga and Gb shown in FIGS. 4(*a*) and 4(*b*). In response to this selection, the control unit 41 searches the image memory 42 for the front and back side image data Da and Db. Following that, under the control of the control unit 41, the front and back side images Ga and Gb are reduced and displayed on the screen of the display unit 51 as shown in FIGS. 4(*a*) and 4(*b*). A first mode selection box 57 assigned for full selection mode and a second mode selection box 58 assigned for partial application mode are also displayed on the screen of the display unit 51 as shown in FIG. 7(*a*).

Under these circumstances, if the user touches the first mode selection box 57 assigned for full selection mode, the control unit 41 enters full selection mode and waits for the user to specify an enlargement/reduction ratio and position for the entire front and back side images Ga and Gb while displaying an enlargement/reduction ratio input unit 61 on the screen of the display unit 51 as shown in FIG. 8(*a*).

When the user touches the second mode selection box 58 assigned for partial application mode, the control unit 41 enters partial application mode and waits for the user to specify an enlargement/reduction ratio and position only for the second image ga2 (non-image region Ra2) for the front side image Ga and an enlargement/reduction ratio and a position of only the second image gb2 (non-image region Rb2) for the back side image Gb while displaying the enlargement/reduction ratio input unit 61 on the screen of the display unit 51 as shown in FIG. 8(*a*).

Therefore, the enlargement/reduction ratio input unit 61, as well as the reduced front and back side images Ga and Gb, is displayed on the screen of the display unit 51.

Since in this context, the front side image Ga is composed of the first image ga1 (image region Ra1) and the second image ga2 (non-image region Ra2) and the back side image Gb is composed of the first image gb1 (image region Rb1) and the second image gb2 (non-image region Rb2), the second image ga2 (non-image region Ra2) and the second image gb2 (non-image region Rb2) do not need to be designated. On the other hand, if none of the first and second images ga1 and ga2 are defined in the front side image Ga, a region may be specified with respect to the reference position Q for the front side image Ga, and then the first and second images ga1 and ga2 be specified for the front side image Ga; if none of the first and second images gb1 and gb2 are defined in the back side image Gb, a region may be specified with respect to the reference position Q for the back side image Gb, and then the first and second images gb1 and gb2 be specified for the back side image Gb. The user can designate a region with respect to the reference position Q for the front side image Ga or the back side image Gb, for example, by the following method. Separation distances from the reference position Q, one in direction X and the other in direction Y, are specified. A position (arbitrary coordinate position with its origin at the reference position Q) that is separated from the reference position Q by the separation distances is arbitrarily determined. An arbitrary rectangular region having two of its diagonally located apexes at the reference position Q and the arbitrarily determined position is specified as an image region. Cutting marks are specified at predetermined positions outside the image region. A frame-shaped non-image region including these cutting marks and their backgrounds and margins is specified outside the image region. Alternatively, the user may designate diagonally located apexes for an arbitrary rectangular region in either the front side image Ga or the back side image Gb by touching the screen of the display unit 51. Then, this rectangular region may be specified as an image region, and cutting marks specified at predetermined positions outside the image region, so that a frame-shaped non-image region including these cutting marks and their backgrounds and margins can be specified outside the image region.

As described above, when either the full selection mode or the partial application mode is selected, the enlargement/reduction ratio input unit 61 is displayed on the screen of the display unit 51 as shown in FIG. 8(*a*), and the reduced front and back side images Ga and Gb are displayed on the screen of the display unit 51.

The enlargement/reduction ratio input unit 61 displays a front-side X-enlargement/reduction ratio column 62 in which the enlargement/reduction ratio for direction X (lateral direction) on the front side of the recording paper P is to be displayed, a front-side Y-enlargement/reduction ratio column 63 in which the enlargement/reduction ratio for direction Y (longitudinal direction) on the front side of the recording paper P is to be displayed, a plus (+) and a minus (−) key 62*a* and 62*b* for the front-side X-enlargement/reduction ratio column 62, and a plus and a minus key 63*a* and 63*b* for the front-side Y-enlargement/reduction ratio column 63. The enlargement/reduction ratio input unit 61 also displays a back-side X-enlargement/reduction ratio column 64 in which the enlargement/reduction ratio for direction X (lateral direction) on the back side of the recording paper P is to be displayed, a back-side Y-enlargement/reduction ratio column 65 in which the enlargement/reduction ratio for direction Y (longitudinal direction) on the back side of the recording paper P is to be displayed, a plus and a minus key 64*a* and 64*b* for the back-side X-enlargement/reduction ratio column 64, and a plus and a minus key 65*a* and 65*b* for the back-side Y-enlargement/reduction ratio column 65. The enlargement/reduction ratio input unit 61 also displays an OK button 66, a test print button 67, and an initial setup button 68.

FIG. 8(*b*) shows the functions of the front-side X-enlargement/reduction ratio column 62, the front-side Y-enlargement/reduction ratio column 63, the back-side X-enlargement/reduction ratio column 64, the back-side Y-enlargement/reduction ratio column 65, the test print button 67, and the initial setup button 68 in an organized manner.

The enlargement/reduction ratio input unit 61 displays "100.00"% as an initial setup value of the enlargement/reduction ratio in each of the front-side X-enlargement/reduction ratio column 62, the front-side Y-enlargement/reduction ratio column 63, the back-side X-enlargement/reduction ratio column 64, and the back-side Y-enlargement/reduction ratio column 65. In this state, when the user selectively touches the plus or minus key 62*a* or 62*b* for the front-side X-enlargement/reduction ratio column 62, the enlargement/reduction ratio shown in the front-side X-enlargement/reduction ratio column 62 increases or decreases accordingly; when the user selectively touches the plus or minus key 63*a* or 63*b* for the front-side Y-enlargement/reduction ratio column 63, the enlargement/reduction ratio shown in the front-side Y-enlargement/reduction ratio column 63 increases or decreases accordingly; when the user selectively touches the plus or minus key 64*a* or 64*b* for the back-side X-enlargement/reduction ratio column 64, the enlargement/reduction ratio shown in the back-side X-enlargement/reduction ratio column 64 increases or decreases accordingly; and when the user selectively touches the plus or minus key 65*a* or 65*b* for the back-side Y-enlargement/reduction ratio column 65, the enlargement/reduction ratio shown in the back-side Y-enlargement/reduction ratio column 65 increases or decreases accordingly.

A touch on the initial setup button 68 resets the enlargement/reduction ratios shown in the enlargement/reduction ratio columns 62 to 65 to the initial setup value, "100.00"%.

After the enlargement/reduction ratios shown in the enlargement/reduction ratio columns 62 to 65 are adjusted in this manner, a touch on the OK button 66 causes the enlargement/reduction ratios shown in the enlargement/reduction ratio columns 62 to 65 to be stored in a built-in memory 41*a* in the control unit 41 under the control of the control unit 41. Under these circumstances, if the full selection mode is being selected, the enlargement/reduction ratio shown in the front-side X-enlargement/reduction ratio column 62 and the enlargement/reduction ratio shown in the front-side Y-enlargement/reduction ratio column 63 are stored in the memory 41*a* as the enlargement/reduction ratios for use on the entire front side image Ga, and the enlargement/reduction ratio shown in the back-side X-enlargement/reduction ratio column 64 and the enlargement/reduction ratio shown in the back-side Y-enlargement/reduction ratio column 65 are stored in the memory 41*a* as the enlargement/reduction ratios for use on the entire back side image Gb. On the other hand, if the partial application mode is being selected, the enlargement/reduction ratio shown in the front-side X-enlargement/reduction ratio column 62 and the enlargement/reduction ratio shown in the front-side Y-enlargement/reduction ratio column 63 are stored in the memory 41*a* as the enlargement/reduction ratios for use solely on the second image ga2 for the front side image Ga, and the enlargement/reduction ratio shown in the back-side X-enlargement/reduction ratio column 64 and the enlargement/reduction ratio shown in the back-side Y-enlargement/reduction ratio column 65 are stored in the memory 41*a* as the enlargement/reduction ratios for use solely on the second image gb2 for the back side image Gb.

A touch on the OK button 66 causes a position input unit 71 to be displayed on the screen of the display unit 51 under the control of the control unit 41 as shown in FIG. 9(*a*). The position input unit 71 displays a front-side X-position column 72 in which an X-direction (lateral-direction) position on the front side of the recording paper P is displayed, a front-side Y-position column 73 in which a Y-direction (longitudinal-direction) position on the front side of the recording paper P is displayed, a plus and a minus key 72*a* and 72*b* for the front-side X-position column 72, and a plus and a minus key 73*a* and 73*b* for the front-side Y-position column 73. The position input unit 71 also displays a back-side X-position column 74 in which an X-direction (lateral-direction) position on the back side of the recording paper P is displayed, a back-side Y-position column 75 in which a Y-direction (longitudinal-direction) position on the back side of the recording paper P is displayed, a plus and a minus key 74*a* and 74*b* for the back-side X-position column 74, and a plus and a minus key 75*a* and 75*b* for the back-side Y-position column 75. The position input unit 71 also displays an OK button 76, a test print button 77, a millimeter button 78, and an inch button 79.

FIG. 9(*b*) shows the functions of the front-side X-position column 72, the front-side Y-position column 73, the back-side X-position column 74, the back-side Y-position column 75, the test print button 77, the millimeter button 78, and the inch button 79 in an organized manner.

The position input unit 71 displays "0.0" millimeters as an initial setup value of the shift distance in each of the front-side X-position column 72, the front-side Y-position column 73, the back-side X-position column 74, and the back-side Y-position column 75. In this state, when the user selectively touches the plus or minus key 72*a* or 72*b* for the front-side X-position column 72, the shift distance shown in the front-side X-position column 72 increases or decreases accordingly; when the user selectively touches the plus or minus key 73*a* or 73*b* for the front-side Y-position column 73, the shift distance shown in the front-side Y-position column 73 increases or decreases accordingly; when the user selectively touches the plus or minus key 74*a* or 74*b* for the back-side X-position column 74, the shift distance shown in the back-side X-position column 74 increases or decreases accordingly; and when the user selectively touches the plus or minus key 75*a* or 75*b* for the back-side Y-position column 75, the shift distance shown in the back-side Y-position column 75 increases or decreases accordingly.

A touch on the inch button 79 converts the shift distances shown in the position columns 72 to 75 from millimeters to inches. Conversely, when the shift distances shown in the position columns 72 to 75 are shown in inches, a touch on the millimeter button 78 converts the shift distances shown in the position columns 72 to 75 from inches to millimeters. The values obtained from the conversion from millimeters to inches and vice versa are rounded up or down at the place of the highest digit after the decimal point that cannot be displayed in the position columns 72 to 75.

After the shift distances shown in the position columns 72 to 75 are adjusted in this manner, a touch on the OK button 76 causes the shift distances shown in the position columns 72 to 75 to be stored in the built-in memory 41*a* in the control unit 41 under the control of the control unit 41. Under these circumstances, if the full selection mode is being selected, the shift distances shown in the front-side X-position column 72 and the front-side Y-position column 73 are stored in the memory 41*a* as the shift distances for use on the entire front side image Ga, and the shift distances shown in the back-side X-position column 74 and the back-side Y-position column 75 are stored in the memory 41*a* as the shift distances for use on the entire back side image Gb. On the other hand, if the partial application mode is being selected, the shift distances shown in the front-side X-position column 72 and the front-side Y-position column 73 are stored in the memory 41*a* as the shift distances for use solely on the second image ga2 for the front side image Ga, and the shift distances shown in the back-side X-position column 74 and the back-side Y-position column 75 are stored in the memory 41*a* as the shift distances for use solely on the second image gb2 for the back side image Gb.

A touch on the OK button 76 causes the enlargement/reduction ratio input unit 61 to be displayed again on the screen of the display unit 51 as shown in FIG. 8(*a*), allowing the user to input enlargement/reduction ratios into the enlargement/reduction ratio columns 62 to 65 on the enlargement/reduction ratio input unit 61. A touch on the OK button 66 on the enlargement/reduction ratio input unit 61 causes the enlargement/reduction ratios shown in the enlargement/reduction ratio columns 62 to 65 to be stored in the built-in memory 41*a* in the control unit 41, thereby updating the memory content. Then, the position input unit 71 is displayed again on the screen of the display unit 51 as shown in FIG. 9(*a*), allowing the user to input shift distances into the position columns 72 to 75 on the position input unit 71. Therefore, a touch on the OK buttons 66 and 76 causes the display to be switched between the enlargement/reduction ratio input unit 61 and the position input unit 71, allowing the user to update the enlargement/reduction ratios shown in the enlargement/reduction ratio columns 62 to 65 and the shift distances shown in the position columns 72 to 75.

In response to a touch on the test print button 67 on the enlargement/reduction ratio input unit 61 or on the test print button 77 on the position input unit 71, the control unit 41 retrieves enlargement/reduction ratios for the enlargement/reduction ratio columns 62 to 65 and shift distances for the position columns 72 to 75 from the built-in memory 41*a* in the control unit 41, feeds them to the image processing unit 44, and starts up the printing unit 4. The image processing unit 44 performs image processing on the front side image data Da stored in the image memory 42 that represents the front side image Ga and the back side image data Db stored in the image memory 42 that represents the back side image Gb, and enlarges/reduces and shifts the entire front side image Ga or the second image ga2 and the entire back side image Gb or the second image gb2 according to the enlargement/reduction ratios shown in the enlargement/reduction ratio columns 62 to 65 and the shift distances shown in the position columns 72 to 75. The printing unit 4 retrieves the front and back side image data Da and Db having been subjected to image processing by the image processing unit 44, prints (forms) the front side image Ga represented by the front side image data Da on the front side of the recording paper P, and subsequently prints (forms) the back side image Gb represented by the back side image data Db on the back side of the recording paper P.

To describe it in more detail, a touch on the test print buttons 67 and 77 with the full selection mode being selected results in enlarging/reducing the entire front side image Ga in direction X by the enlargement/reduction ratio shown in the front-side X-enlargement/reduction ratio column 62 and in direction Y by the enlargement/reduction ratio shown in the front-side Y-enlargement/reduction ratio column 63, shifting the entire front side image Ga along direction X as much as the shift distance shown in the front-side X-position column 72 and along direction Y as much as the shift distance shown in the front-side Y-position column 73, printing (forming) the entire front side image Ga on the front side of the recording paper P, subsequently enlarging/reducing the entire back side image Gb in direction X by the enlargement/reduction ratio shown in the back-side X-enlargement/reduction ratio column 64 and in direction Y by the enlargement/reduction ratio shown in the back-side Y-enlargement/reduction ratio column 65, shifting the entire back side image Gb along direction X as much as the shift distance shown in the back-side X-position column 74 and along direction Y as much as the shift distance shown in the back-side Y-position column 75, and printing (forming) the entire back side image Gb on the back side of the recording paper P.

In short, with the full selection mode being selected, the entire front side image Ga is enlarged/reduced, shifted, and printed (formed) on the front side of the recording paper P. Subsequently, the entire back side image Gb is enlarged/reduced, shifted, and printed (formed) on the back side of the recording paper P.

A touch on the test print buttons 67 and 77 with the partial application mode being selected results in enlarging/reducing only the second image ga2 (non-image region Ra2) for the front side image Ga in direction X by the enlargement/reduction ratio shown in the front-side X-enlargement/reduction ratio column 62 and in direction Y by the enlargement/reduction ratio shown in the front-side Y-enlargement/reduction ratio column 63, shifting only the second image ga2 for the front side image Ga along direction X as much as the shift distance shown in the front-side X-position column 72 and along direction Y as much as the shift distance shown in the front-side Y-position column 73, printing (forming) the second image ga2 for the front side image Ga on the front side of the recording paper P, printing (forming) the first image ga1 for the front side image Ga on the front side of the recording paper P without enlarging/reducing or shifting the first image ga1, subsequently enlarging/reducing only the second image gb2 (non-image region Rb2) for the back side image Gb in direction X by the enlargement/reduction ratio shown in the back-side X-enlargement/reduction ratio column 64 and in direction Y by the enlargement/reduction ratio shown in the back-side Y-enlargement/reduction ratio column 65, shifting only the second image gb2 along direction X as much as the shift distance shown in the back-side X-position column 74 and along direction Y as much as the shift distance shown in the back-side Y-position column 75, printing (forming) the second image gb2 for the back side image Gb on the back side of the recording paper P, and printing (forming) the first image gb1 for the back side image Gb on the back side of the recording paper P without enlarging/reducing or shifting the first image gb1.

In short, with the partial application mode being selected, the second image ga2 (non-image region Ra2) for the front side image Ga is enlarged/reduced, shifted, and printed (formed) on the front side of the recording paper P, and the first image ga1 for the front side image Ga is printed (formed) on the front side of the recording paper P without being enlarged/reduced or shifted. The second image gb2 (non-image region Rb2) for the back side image Gb is enlarged/reduced, shifted, and printed (formed) on the back side of the recording paper P, and the first image gb1 for the back side image Gb is printed (formed) on the back side of the recording paper P without being enlarged/reduced or shifted.

Figure 5A:
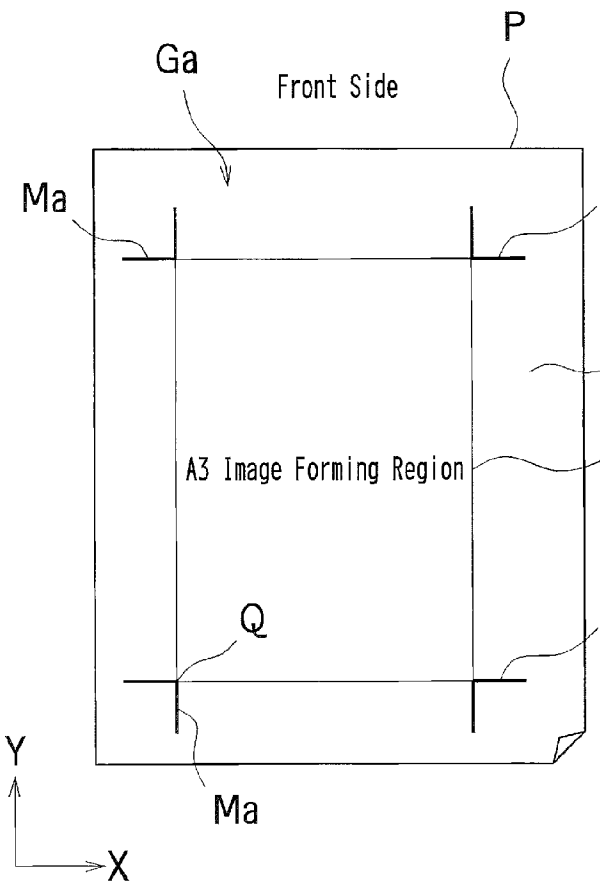
FIG. 5(*a*) is an illustration representing a front side image formed on the front side of recording paper before the paper shrinks.
Figure 5B:
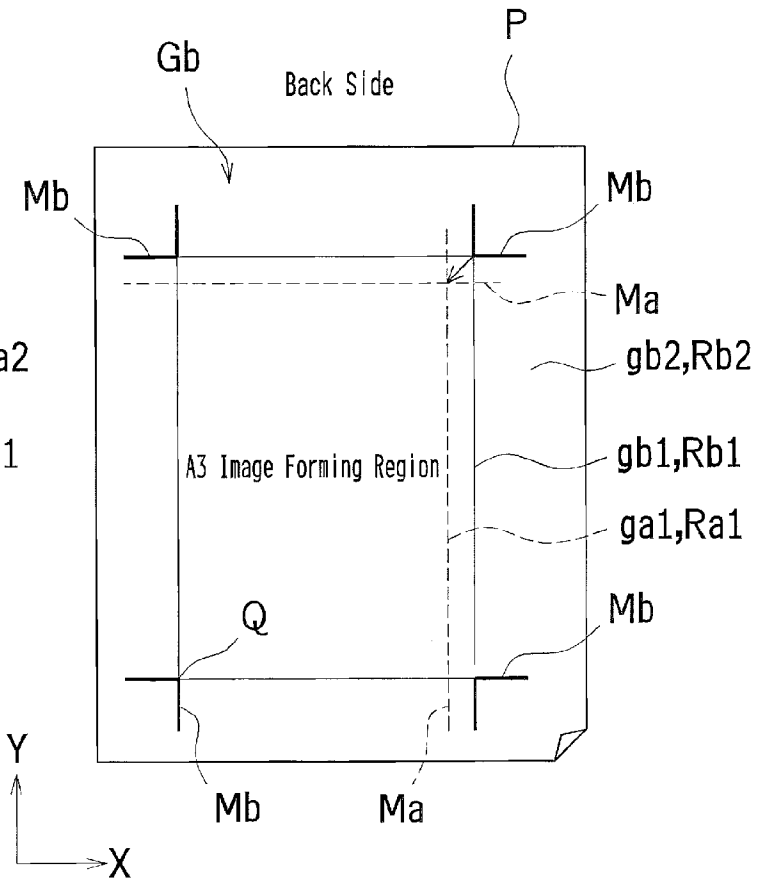
Figures 6A, 6B:
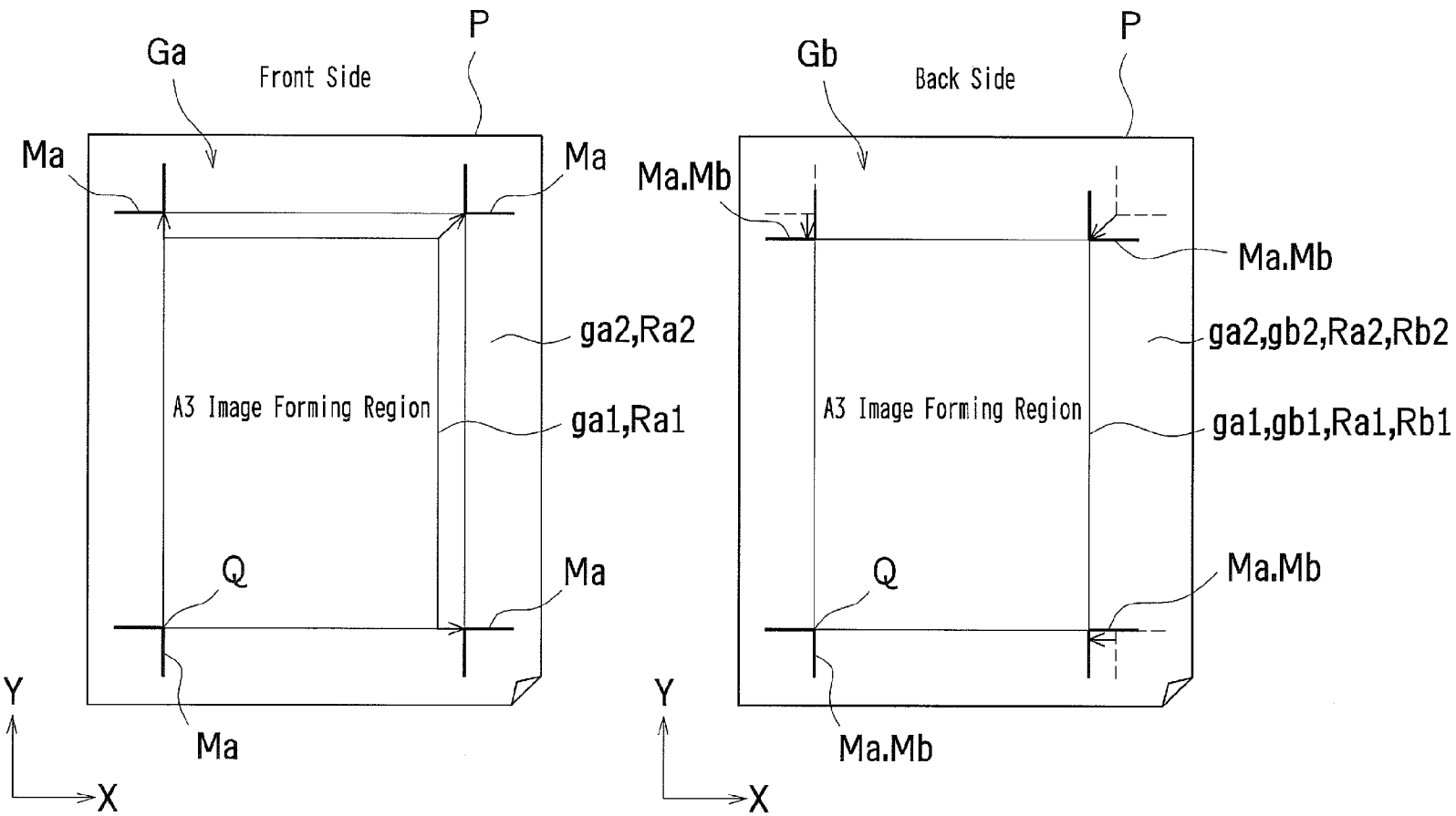
FIG. 6(*a*) is an illustration representing a front-side, enlarged image formed on the front side of the recording paper before the paper shrinks.

As shown in FIGS. 5(*a*) and 5(*b*), if the front side image Ga shrinks in accordance with shrinkage of the recording paper P, causing a deviation between the cutting marks Ma, which are a part of the second image ga2 for the front side image Ga, and the cutting marks Mb, which are a part of the second image gb2 for the back side image Gb, when only the second image ga2 (non-image region Ra2) for the front side image Ga is enlarged by a suitable enlargement/reduction ratio as shown in FIGS. 6(*a*) and 6(*b*), the second image ga2 (non-image region Ra2) for the front side image Ga and the second image gb2 (non-image region Rb2) for the back side image Gb come to have the same size, and the cutting marks Ma, which are a part of the second image ga2, and the cutting marks Mb, which are a part of the second image gb2, are substantially superimposed on the front and back sides of the recording paper P. Therefore, if the enlargement/reduction ratio input unit 61 is displayed on the screen of the display unit 51 with the partial application mode being selected, the user can render the cutting marks Ma, which are a part of the second image ga2, and the cutting marks Mb, which are a part of the second image gb2, substantially superimposed on the front and back sides of the recording paper P by specifying an enlargement/reduction ratio in the front-side X-enlargement/reduction ratio column 62 and an enlargement/reduction ratio in the front-side Y-enlargement/reduction ratio column 63, i.e., by specifying enlargement/reduction ratios only for the second image ga2 for the front side image Ga in a suitable manner.

Nevertheless, in actuality, the shrinkage of the recording paper P could cause positional deviation and other defects between the second image ga1 for the front side image Ga and the second image gb1 for the back side image Gb. If such a defect develops, it becomes necessary to adjust the position of the second image ga1 for the front side image Ga and the position of the second image gb1 for the back side image Gb on the position input unit 71. For these purposes, the enlargement/reduction ratio input unit 61 allows the user to specify a shift distance for both the second image ga2 for the front side image Ga and the second image gb2 for the back side image Gb.

Figure 10:
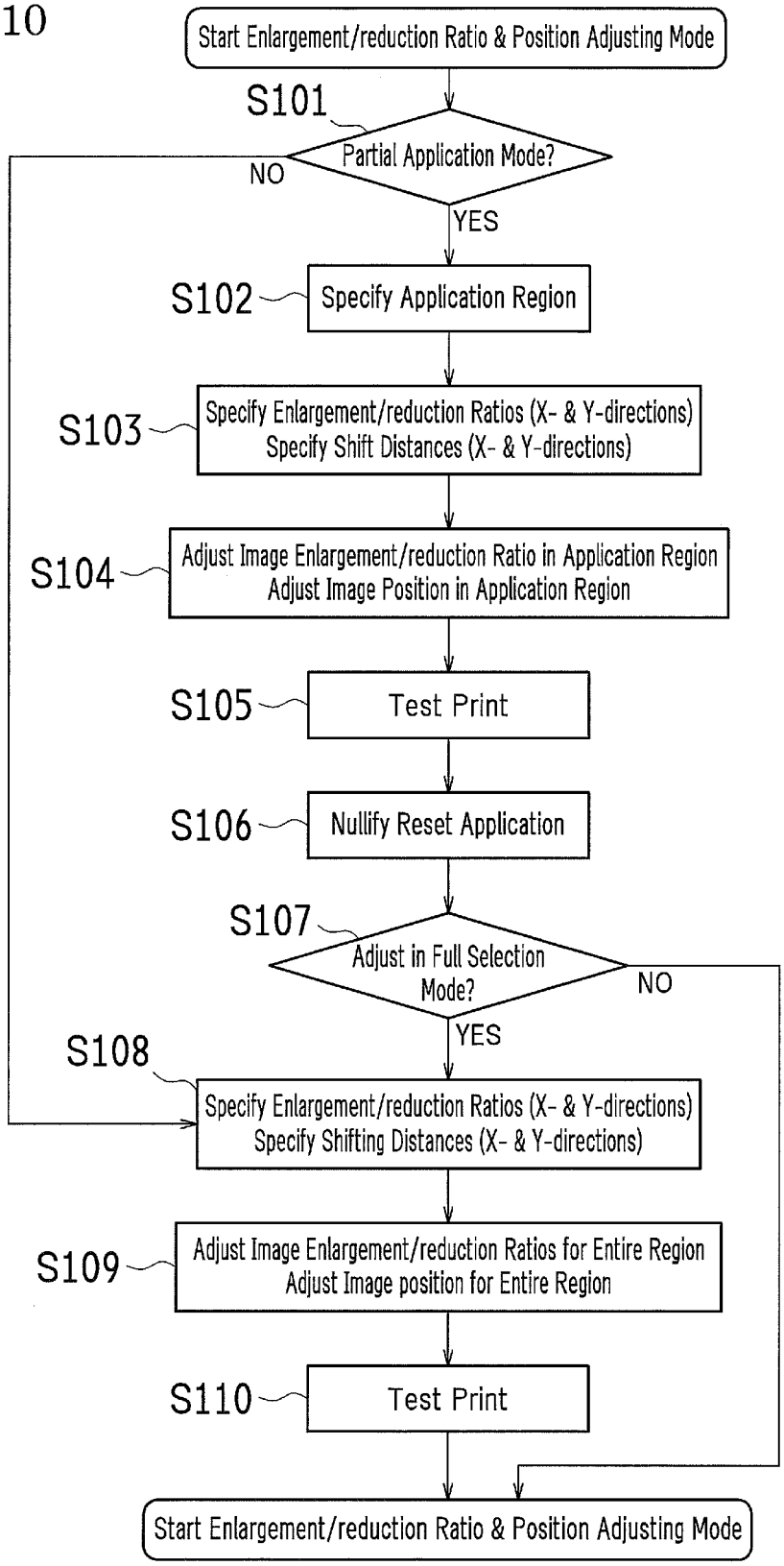
FIG. 10 is a flow chart depicting a process that specifies an enlargement/reduction ratio and an after-shifting position of the image to be formed on the front side of the recording paper and an enlargement/reduction ratio and an after-shifting position of the image to be formed on the back side of the recording paper.

Next, referring to the flow chart in FIG. 10, a practical manual operation process will be described that renders the cutting marks Ma, which are a part of the second image ga2, and the cutting marks Mb, which are a part of the second image gb2, superimposed on the front and back sides of the recording paper P.

First, when the user touches, on the initial setup screen of the display unit 51 shown in FIG. 3, the function selection box 56*d* assigned for an aligning function for the front and back side images Ga and Gb, a list (not shown) of image data stored in the image memory 42 is displayed on the screen of the display unit 51. The list contains the front and back side image data Da and Db representing respectively the front and back side images Ga and Gb shown in FIGS. 4(*a*) and 4(*b*). When the user touches the front side image data Da (or the back side image data Db) in the list, the front side image data Da (or the back side image data Db) is selected, and the first mode selection box 57 assigned for full selection mode and the second mode selection box 58 assigned for partial application mode are displayed on the screen of the display unit 51 as shown in FIG. 7(*a*).

Under these circumstances, if the user touches the first mode selection box 57 assigned for full selection mode ("No" in step S101), the control unit 41 enters full selection mode, proceeding to steps S108 to S110 which will be described later.

On the other hand, if the user touches the second mode selection box 58 assigned for partial application mode ("Yes" in step S101), the control unit 41 enters the partial application mode, selecting the second image ga2 (non-image region Ra2) for the front side image Ga and the second image gb2 (non-image region Rb2) for the back side image Gb (step S102). In step S102, as described previously, the user specifies separation distances from the reference position Q, one in direction X and the other in direction Y, for the front side image Ga or the back side image Gb. A position that is separated from the reference position Q by the separation distances is arbitrarily determined. An arbitrary rectangular region having two of its diagonally located apexes at the reference position Q and the arbitrarily determined position is specified as an image region. Cutting marks are specified at predetermined positions outside the image region. A frame-shaped non-image region including these cutting marks and their backgrounds and margins is specified outside the image region. Alternatively, the user may designate diagonally located apexes for an arbitrary rectangular region in either the front side image Ga or the back side image Gb by touching the screen of the display unit 51. Then, this rectangular region may be specified as an image region, and a frame-shaped non-image region including, for example, cutting marks at predetermined positions outside the image region be specified outside the image region.

The enlargement/reduction ratio input unit 61 is displayed on the screen of the display unit 51 upon entering the partial application mode. The user adjusts the enlargement/reduction ratios shown in the enlargement/reduction ratio columns 62 to 65 on the enlargement/reduction ratio input unit 61 and touches the OK button 66 on the enlargement/reduction ratio input unit 61 (step S103). Accordingly, the enlargement/reduction ratios shown in the enlargement/reduction ratio columns 62 to 65 are stored in the memory 41*a* in the control unit 41 as the enlargement/reduction ratios for partial application mode (step S104).

Subsequently, the position input unit 71 is displayed on the screen of the display unit 51. The user then adjusts the shift distances shown in the position columns 72 to 75 on the position input unit 71 and touches the OK button 76 on the position input unit 71 (step S103). In response to the touch, the shift distances shown in the position columns 72 to 75 are stored in the memory 41*a* in the control unit 41 as the shift distances for partial application mode (step S104).

The enlargement/reduction ratios shown in the enlargement/reduction ratio columns 62 to 65 and the shift distances shown in the position columns 72 to 75 are stored in this manner as the enlargement/reduction ratios and shift distances for partial application mode. Thereafter, a touch on the test print button 67 on the enlargement/reduction ratio input unit 61 or on the test print button 77 on the position input unit 71 results in enlarging/reducing only the second image ga2 (non-image region Ra2) for the front side image Ga by the enlargement/reduction ratio shown in the front-side X-enlargement/reduction ratio column 62 and the enlargement/reduction ratio shown in the front-side Y-enlargement/reduction ratio column 63, shifting only the second image ga2 as much as the shift distance shown in the front-side X-position column 72 and the shift distance shown in the front-side Y-position column 73, printing (forming) the second image ga2 on the front side of the recording paper P, printing (forming) the first image ga1 (image region Ra1) for the front side image Ga on the front side of the recording paper P without enlarging/reducing or shifting the first image ga1, subsequently enlarging/reducing only the second image gb2 (non-image region Rb2) for the back side image Gb by the enlargement/reduction ratio shown in the back-side X-enlargement/reduction ratio column 64 and the enlargement/reduction ratio shown in the back-side Y-enlargement/reduction ratio column 65, shifting only the second image gb2 as much as the shift distance shown in the back-side X-position column 74 and the shift distance shown in the back-side Y-position column 75, printing (forming) the second image gb2 on the back side of the recording paper P, and printing (forming) the first image gb1 (image region Rb1) for the back side image Gb on the back side of the recording paper P without enlarging/reducing or shifting the first image gb1 (step S105).

Therefore, with the partial application mode being selected, only the second image ga2 for the front side image Ga is enlarged/reduced, shifted, and printed (formed) on the front side of the recording paper P, the first image ga1 for the front side image Ga is printed (formed) on the front side of the recording paper P without being enlarged/reduced or shifted, only the second image gb2 for the back side image Gb is enlarged/reduced, shifted, and printed (formed) on the back side of the recording paper P, and the first image gb1 for the back side image Gb is printed (formed) on the back side of the recording paper P without being enlarged/reduced or shifted.

Thereafter, upon temporarily exiting the partial application mode (step S106), the first mode selection box 57 and the cancel button 59 for the full selection mode are displayed on the screen of the display unit 51 as shown in FIG. 7(*b*) (step S107). Under these circumstances, a touch on the cancel button 59 ("No" in step S107) terminates the process shown in FIG. 10.

Upon a touch on the first mode selection box 57 assigned for full selection mode ("Yes" in step S107), the entire front side image Ga is selected and at the same time, the enlargement/reduction ratio input unit 61 is displayed on the screen of the display unit 51. The user adjusts the enlargement/reduction ratios shown in the enlargement/reduction ratio columns 62 to 65 on the enlargement/reduction ratio input unit 61 and touches the OK button 66 on the enlargement/reduction ratio input unit 61 (step S108). Accordingly, the enlargement/reduction ratios shown in the enlargement/reduction ratio columns 62 to 65 are stored in the memory 41*a* in the control unit 41 as the enlargement/reduction ratios for full selection mode (step S109). Subsequently, the position input unit 71 is displayed on the screen of the display unit 51. The user adjusts the shift distances shown in the position columns 72 to 75 on the position input unit 71 and touches the OK button 76 on the position input unit 71 (step S108). In response to the touch, the shift distances shown in the position columns 72 to 75 are stored in the memory 41*a* in the control unit 41 as the shift distances for full selection mode (step S109).

The enlargement/reduction ratios shown in the enlargement/reduction ratio columns 62 to 65 and the shift distances shown in the position columns 72 to 75 are stored in this manner as the enlargement/reduction ratios and shift distances for full selection mode. Thereafter, a touch on the test print button 67 on the enlargement/reduction ratio input unit 61 or the test print button 77 on the position input unit 71 results in enlarging/reducing the entire front side image Ga by the enlargement/reduction ratio shown in the front-side X-enlargement/reduction ratio column 62 and the enlargement/reduction ratio shown in the front-side Y-enlargement/reduction ratio column 63, shifting the entire front side image Ga as much as the shift distance shown in the front-side X-position column 72 and the shift distance shown in the front-side Y-position column 73, printing (forming) the entire front side image Ga on the front side of the recording paper P, subsequently enlarging/reducing the entire back side image Gb by the enlargement/reduction ratio shown in the back-side X-enlargement/reduction ratio column 64 and the enlargement/reduction ratio shown in the back-side Y-enlargement/reduction ratio column 65, shifting the entire back side image Gb as much as the shift distance shown in the back-side X-position column 74 and the shift distance shown in the back-side Y-position column 75, and printing (forming) the entire back side image Gb on the back side of the recording paper P (step S110).

Therefore, with the full selection mode being selected, the entire front side image Ga is enlarged/reduced, shifted, and printed (formed) on the front side of the recording paper P, and the entire back side image Gb is enlarged/reduced, shifted, and printed (formed) on the back side of the recording paper P.

As described above, in the first embodiment, when the partial application mode is selected, the front side image Ga may be printed (formed) on the front side of the recording paper P after only the second image ga2 for the front side image Ga is enlarged/reduced and shifted, and the back side image Gb may be printed (formed) on the back side of the recording paper P after only the second image gb2 for the back side image Gb is enlarged/reduced and shifted. Therefore, the size and position of the second image ga2 on the front side of the recording paper P and the size and position of the second image gb2 on the back side of the recording paper P can be specified freely.

Therefore, only the second image ga2 for the front side image Ga can be enlarged by a suitable enlargement/reduction ratio as illustrated in FIG. 6(*a*), and the cutting marks Ma, which are a part of the second image ga2 for the front side image Ga, and the cutting marks Mb, which are a part of the second image gb2 for the back side image Gb, be rendered substantially superimposed as illustrated in FIG. 6(*b*).

If there occurs, for example, a positional deviation between the second image ga1 for the front side image Ga and the second image gb1 for the back side image Gb due to the shrinkage of the recording paper P, the relative positions of the second image ga2 for the front side image Ga and the second image gb2 for the back side image Gb may be fine-tuned. For example, if the recording paper P shrinks as it is heated by the fixing device 17, the second image ga2 and the second image gb2 could be displaced, in which case fine-tuning their relative positions is effective.

Furthermore, instead of enlarging/reducing only the second image ga1 for the front side image Ga, the second image gb1 for the back side image Gb may also be enlarged/reduced.

If the full selection mode is selected, the entire front side image Ga is enlarged/reduced, shifted, and printed (formed) on the front side of the recording paper P, and the entire back side image Gb is enlarged/reduced, shifted, and printed (formed) on the back side of the recording paper P. By comparing the deviation between the front side image Ga and the back side image Gb formed in the full selection mode and the deviation between the front side image Ga and the back side image Gb formed in the partial application mode, it can be readily determined whether or not the enlargement/reduction ratio and shift distance for the second image ga2 for the front side image Ga in the partial application mode and the enlargement/reduction ratio and shift distance for the second image gb2 for the back side image Gb in the partial application mode have been appropriately adjusted.

Furthermore, the enlargement/reduction ratio and after-shifting position of the front side image Ga and the enlargement/reduction ratio and after-shifting position of the back side image Gb are stored in the image memory 42 as secondary information on the front and back side images Ga and Gb when the cutting marks Ma, which are a part of the second image ga2 for the front side image Ga, and the cutting marks Mb, which are a part of the second image gb2 for the back side image Gb, are successfully rendered superimposed. If the front and back side images Ga and Gb are printed on the recording paper P, the front side image Ga is printed on the front side of the recording paper P according to the enlargement/reduction ratio and after-shifting position of the front side image Ga, and the back side image Gb is printed on the back side of the recording paper P according to the enlargement/reduction ratio and after-shifting position of the back side image Gb. Accordingly, the superimposition of the cutting marks Ma on the front side of the recording paper P and the cutting marks Mb on the back side of the recording paper P can be reproduced.

The first embodiment assumes that the recording paper P shrinks as it is heated by the fixing device 17. Depending on the substance and type of the recording paper P, the recording paper P could expand during printing on its front side. When this is actually the case, the cutting marks Ma on the front side of the recording paper P and the cutting marks Mb on the back side of the recording paper P can be rendered superimposed by printing (forming) the second image gb2 for the back side image Gb on the back side of the recording paper P after enlarging the second image gb2 by a suitable enlargement/reduction ratio.

The present invention encompasses not only enlargement of the second image ga2 for the front side image Ga or the second image gb2 for the back side image Gb, but also reduction of the second image ga2 or the second image gb2. The second image ga2 and the second image gb2 may be superimposed by reducing either one of the second image ga2 and the second image gb2, for example, when the first image ga1 has such a margin on its four sides in the front side image Ga that a reduced second image ga2 practically does not interfere with the text, photographs, drawings, etc. in the first image ga1 or when the first image gb1 has such a margin on its four sides in the back side image Gb that a reduced second image gb2 practically does not interfere with the text, photographs, drawings, etc. in the first image gb1. The second image ga2 and the second image gb2 may be superimposed by reducing either one of the second image ga2 and the second image gb2 also when the second image ga2 is reduced in the front side image Ga in such a manner that the reduced second image ga2, even if practically interfering with the text, photographs, drawings, background, etc. in the first image ga1, does not raise any problems or when the second image gb2 is reduced in the back side image Gb in such a manner that the reduced second image gb2, even if practically interfering with the text, photographs, drawings, background, etc. in the first image gb1, does not raise any problems. Therefore, in the present invention, the second image ga2 (non-image region Ra2) may be reduced and superimposed on a part of the first image ga1 (image region Ra1), and the second image gb2 (non-image region Rb2) may be reduced and superimposed on a part of the first image gb1 (image region Rb1).

Second Embodiment

The second embodiment in accordance with the present invention is similar to the first embodiment in that they are both applied to the image forming apparatus 1 shown in FIG. 1 and that both of them include the control system shown in FIG. 2. The second embodiment differs from the first embodiment in that it forms different images on the front and back sides of the recording paper P from those formed by the first embodiment.

In the first embodiment, the front side image Ga is composed of the first, main image (text, photographs, drawings, etc.) ga1 and the second image ga2 including the cutting marks Ma, and the back side image Gb is likewise composed of the first, main image (text, photographs, drawings, etc.) gb1 and the second image gb2 including the cutting marks Mb. Therefore, the front and back side images Ga and Gb are those images that are actually printed (formed) on the front and back sides of the recording paper P respectively.

Figure 11:
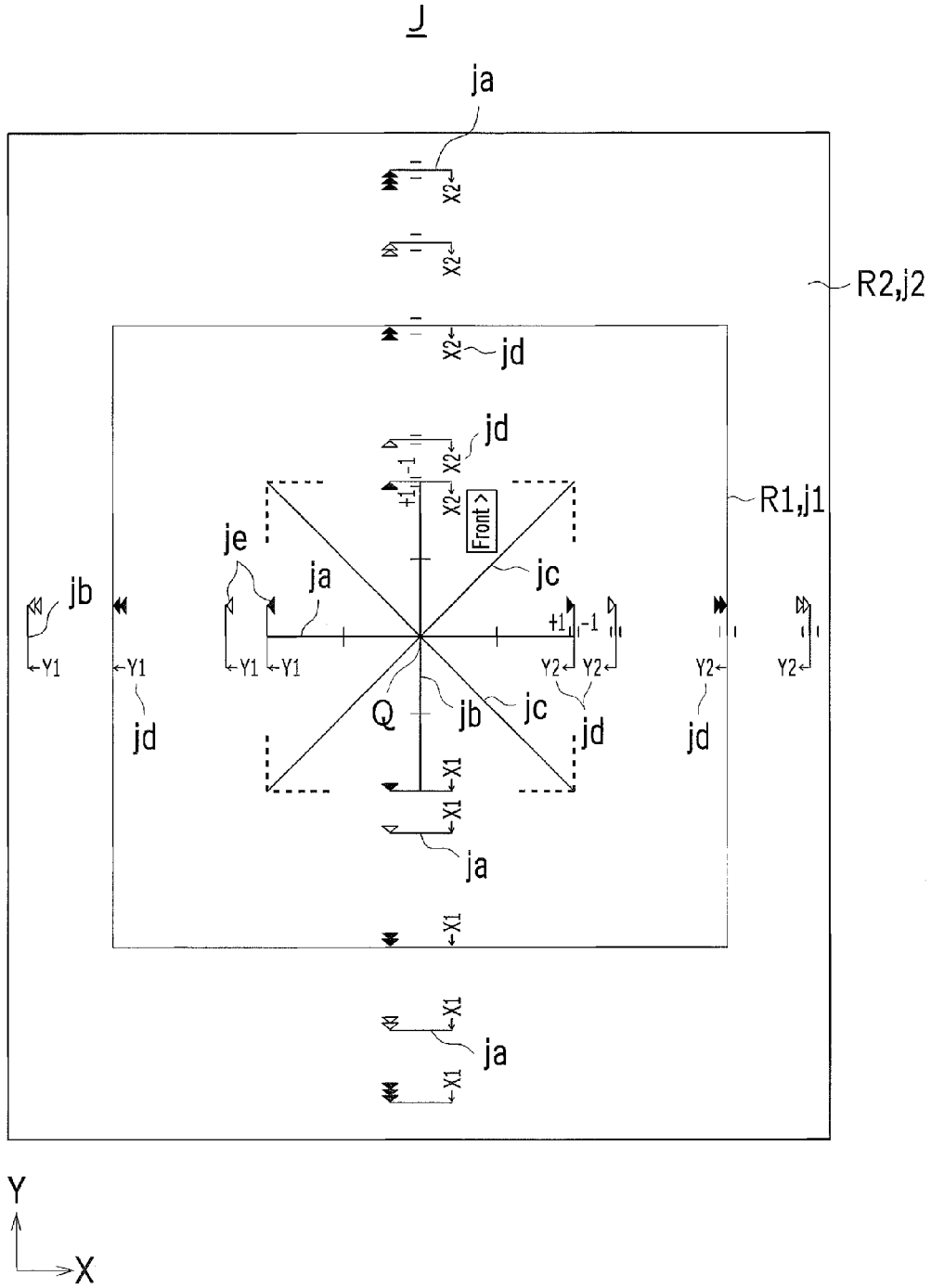
FIG. 11 is a diagram showing an exemplary adjustment pattern formed on the front and back sides of the recording paper in a second embodiment.

In contrast, in the second embodiment, an adjustment pattern J, shown in FIG. 11, is printed (formed) on both the front and back sides of the recording paper P. This adjustment pattern J is a combination of line segments ja, jb, and jc that extend in direction X (lateral direction), direction Y (longitudinal direction), and oblique directions and also includes letters jd (specifically, "X1", "X2", "Y1" and "Y2") and triangle indicators je that are printed (formed) at many locations on the front and back sides of the recording paper P. The adjustment pattern J is divided into an image region R1 and a non-image region R2 that is outside the image region R1. The image contained in the image region R1 is a first image j1, and the image contained in the non-image region R2 is a second image j2.

The first image j1 includes a reference position Q which is the center of the first image j1. Separation distances are specified for the leftward and rightward directions (direction X) and the upward and downward directions (direction Y) from the reference position Q, so as to specify an image region R1 that has a lateral width corresponding to the left and right separation distances and a longitudinal width corresponding to the upper and lower separation distances. A non-image region R2 is specified as the region outside the image region R1. For example, the user may manually input the left and right separation distances (lateral width) and the upper and lower separation distances (longitudinal width) through the manual input unit 52 on the control panel 7 so as to specify the image region R1 and the non-image region R2. Alternatively, the user may have an adjustment pattern J displayed on the screen of the display unit 51 and specify diagonally located apexes for a rectangular region by touching the screen to designate the rectangular region as an image region R1 and a region outside the image region R1 as a non-image region R2.

Next, referring to the flow chart in FIG. 10, a process will be described for superimposing the second images j2 for the adjustment patterns J printed (formed) on the front and back sides of the recording paper P.

A first mode selection box 57 assigned for full selection mode and a second mode selection box 58 assigned for partial application mode are displayed on the screen of the display unit 51 as shown in FIG. 7(*a*).

Under these circumstances, if the user touches the first mode selection box 57 assigned for full selection mode ("No" in step S101), the control unit 41 enters full selection mode, proceeding to steps S108 to S110 which will be described later.

On the other hand, if the user touches the second mode selection box 58 assigned for partial application mode ("Yes" in step S101), the control unit 41 enters the partial application mode, selecting the second image j2 (non-image region R2) for the adjustment pattern J (step S102). In step S102, as described previously, the user specifies separation distances from the reference position Q to the left and right (direction X) and the top and bottom (direction Y) of the reference position Q, which specifies an image region R1 and a non-image region R2 (outside the image region R1). Alternatively, the user may have an adjustment pattern J displayed on the screen of the display unit 51 and specify diagonally located apexes for a rectangular region by touching the screen to designate the rectangular region as an image region R1 and a region outside the image region R1 as a non-image region R2.

The enlargement/reduction ratio input unit 61 is displayed on the screen of the display unit 51 upon entering the partial application mode. The user adjusts the enlargement/reduction ratios shown in the enlargement/reduction ratio columns 62 to 65 on the enlargement/reduction ratio input unit 61 and touches the OK button 66 on the enlargement/reduction ratio input unit 61 (step S103). Accordingly, the enlargement/reduction ratios shown in the enlargement/reduction ratio columns 62 to 65 are stored in the memory 41*a* in the control unit 41 as the enlargement/reduction ratios for partial application mode (step S104). Subsequently, the position input unit 71 is displayed on the screen of the display unit 51. The user then adjusts the shift distances shown in the position columns 72 to 75 on the position input unit 71 and touches the OK button 76 on the position input unit 71 (step S103). In response to the touch, the shift distances shown in the position columns 72 to 75 are stored in the memory 41*a* in the control unit 41 as the shift distances for partial application mode (step S104).

The enlargement/reduction ratios shown in the enlargement/reduction ratio columns 62 to 65 and the shift distances shown in the position columns 72 to 75 are stored in this manner as the enlargement/reduction ratios and shift distances for partial application mode. Thereafter, a touch on the test print button 67 on the enlargement/reduction ratio input unit 61 or on the test print button 77 on the position input unit 71 results in enlarging/reducing only the second image j2 (non-image region R2) for the adjustment pattern J on the front side of the recording paper P by the enlargement/reduction ratio shown in the front-side X-enlargement/reduction ratio column 62 and the enlargement/reduction ratio shown in the front-side Y-enlargement/reduction ratio column 63, shifting only the second image j2 as much as the shift distance shown in the front-side X-position column 72 and the shift distance shown in the front-side Y-position column 73, printing (forming) the second image j2, and printing (forming) the first image j1 for the adjustment pattern J without enlarging/reducing or shifting the first image j1. Subsequently, regarding the back side of the recording paper P, the touch results in enlarging/reducing only the second image j2 (non-image region R2) for the adjustment pattern J by the enlargement/reduction ratio shown in the back-side X-enlargement/reduction ratio column 64 and the enlargement/reduction ratio shown in the back-side Y-enlargement/reduction ratio column 65, shifting only the second image j2 as much as the shift distance shown in the back-side X-position column 74 and the shift distance shown in the back-side Y-position column 75, printing (forming) the second image j2, and printing (forming) the first image j1 for the adjustment pattern J without enlarging/reducing or shifting the first image j1 (step S105). In this step, the second image j2 is enlarged/reduced around a reference position A, either enlarged in such a manner as to move away from the reference position A or reduced in such a manner as to move closer to the reference position A. In addition, the second image j2 is shifted in either direction X or direction Y using the reference position A as the center of the shift.

Therefore, with the partial application mode being selected, the enlargement/reduction ratio and shift distance for the second image j2 (non-image region R2) for the adjustment pattern J can be specified separately for the front side of the recording paper P and for the back side thereof. In addition, for both the front and back sides of the recording paper P, only the second image j2 (non-image region R2) for the adjustment pattern J is enlarged/reduced, shifted, and printed (formed), and the first image j1 for the adjustment pattern J is printed (formed) without being enlarged/reduced or shifted.

Thereafter, upon temporarily exiting the partial application mode (step S106), the first mode selection box 57 and the cancel button 59 for the full selection mode are displayed on the screen of the display unit 51 as shown in FIG. 7(*b*) (step S107). Under these circumstances, a touch on the cancel button 59 ("No" in step S107) terminates the process shown in FIG. 10.

Upon a touch on the first mode selection box 57 assigned for full selection mode ("Yes" in step S107), the entire adjustment pattern J is selected and at the same time, the enlargement/reduction ratio input unit 61 is displayed on the screen of the display unit 51. The user adjusts the enlargement/reduction ratios shown in the enlargement/reduction ratio columns 62 to 65 on the enlargement/reduction ratio input unit 61 and touches the OK button 66 on the enlargement/reduction ratio input unit 61 (step S108). Accordingly, the enlargement/reduction ratios shown in the enlargement/reduction ratio columns 62 to 65 are stored in the memory 41*a* in the control unit 41 as the enlargement/reduction ratios for full selection mode (step S109). Subsequently, the position input unit 71 is displayed on the screen of the display unit 51. The user adjusts the shift distances shown in the position columns 72 to 75 on the position input unit 71 and touches the OK button 76 on the position input unit 71 (step S108). In response to the touch, the shift distances shown in the position columns 72 to 75 are stored in the memory 41*a* in the control unit 41 as the shift distances for full selection mode (step S109).

The enlargement/reduction ratios shown in the enlargement/reduction ratio columns 62 to 65 and the shift distances shown in the position columns 72 to 75 are stored in this manner as the enlargement/reduction ratios and shift distances for full selection mode. Thereafter, a touch on the test print button 67 on the enlargement/reduction ratio input unit 61 or the test print button 77 on the position input unit 71 results in enlarging/reducing the entire adjustment pattern J on the front side of the recording paper P by the enlargement/reduction ratio shown in the front-side X-enlargement/reduction ratio column 62 and the enlargement/reduction ratio shown in the front-side Y-enlargement/reduction ratio column 63, shifting the entire adjustment pattern J as much as the shift distance shown in the front-side X-position column 72 and the shift distance shown in the front-side Y-position column 73, and printing (forming) the entire adjustment pattern J. Subsequently, regarding the back side of the recording paper P, the touch results in enlarging/reducing entire adjustment pattern J by the enlargement/reduction ratio shown in the back-side X-enlargement/reduction ratio column 64 and the enlargement/reduction ratio shown in the back-side Y-enlargement/reduction ratio column 65, shifting the entire adjustment pattern J as much as the shift distance shown in the back-side X-position column 74 and the shift distance shown in the back-side Y-position column 75, and printing (forming) the entire adjustment pattern J (step S110). In this step, the entire adjustment pattern J is enlarged/reduced around the reference position A and shifted in either direction X or direction Y using the reference position A as the center of the shift before being printed (formed).

Therefore, with the full selection mode being selected, the enlargement/reduction ratio and shift distance for the entire adjustment pattern J can be specified separately for the front side of the recording paper P and for the back side thereof. In addition, for both the front and back sides of the recording paper P, the entire adjustment pattern J is enlarged/reduced, shifted, and printed (formed).

In the second embodiment described here, because the adjustment pattern J is composed of the line segments ja, jb, and jc, letters jd, and triangle indicators je, the amount and direction of a deviation between the second image j2 on the front side of the recording paper P and the second image j2 on the back side thereof can be readily recognized. It can be readily determined whether or not the enlargement/reduction ratio and after-shifting position for the second image j2 have been appropriately adjusted.

Furthermore, for example, the first image j2 (image region R1) and the second image j2 (non-image region R2) for the adjustment pattern J are matched with the first image ga1 (image region Ra1) and the second image ga2 (non-image region Ra2) for the front side image Ga shown in FIG. 4(*a*) or with the first image gb1 (image region Rb1) and the second image gb2 (non-image region Rb2) for the back side image Gb shown in FIG. 4(*b*). Thereafter, the enlargement/reduction ratios shown in the enlargement/reduction ratio columns 62 to 65 and the shift distances shown in the position columns 72 to 75 for partial application mode are specified in such a manner as to match the second images j2 on the front and back sides of the recording paper P, before the enlargement/reduction ratios and the shift distances are stored in the memory 41*a*. When this is the case, if the second image ga2 for the front side image Ga and the second image gb2 for the back side image Gb are enlarged/reduced and shifted according to the enlargement/reduction ratios shown in the enlargement/reduction ratio columns 62 to 65 and the shift distances shown in the position columns 72 to 75 before the front and back side images Ga and Gb are printed on the front and back sides of the recording paper P, the cutting marks Ma, which are a part of the second image ga2 for the front side image Ga, and the cutting marks Mb, which are a part of the second image gb2 for the back side image Gb, can be superimposed.

Third Embodiment

In an image forming system of the third embodiment in accordance with the present invention, a personal computer (PC) 8 generates a print job and transmits the print job to the image forming apparatus 1 shown in FIG. 1 over a network, so that the image forming apparatus 1 can print, on recording paper, an image represented by the image data contained in the print job.

Figure 12:
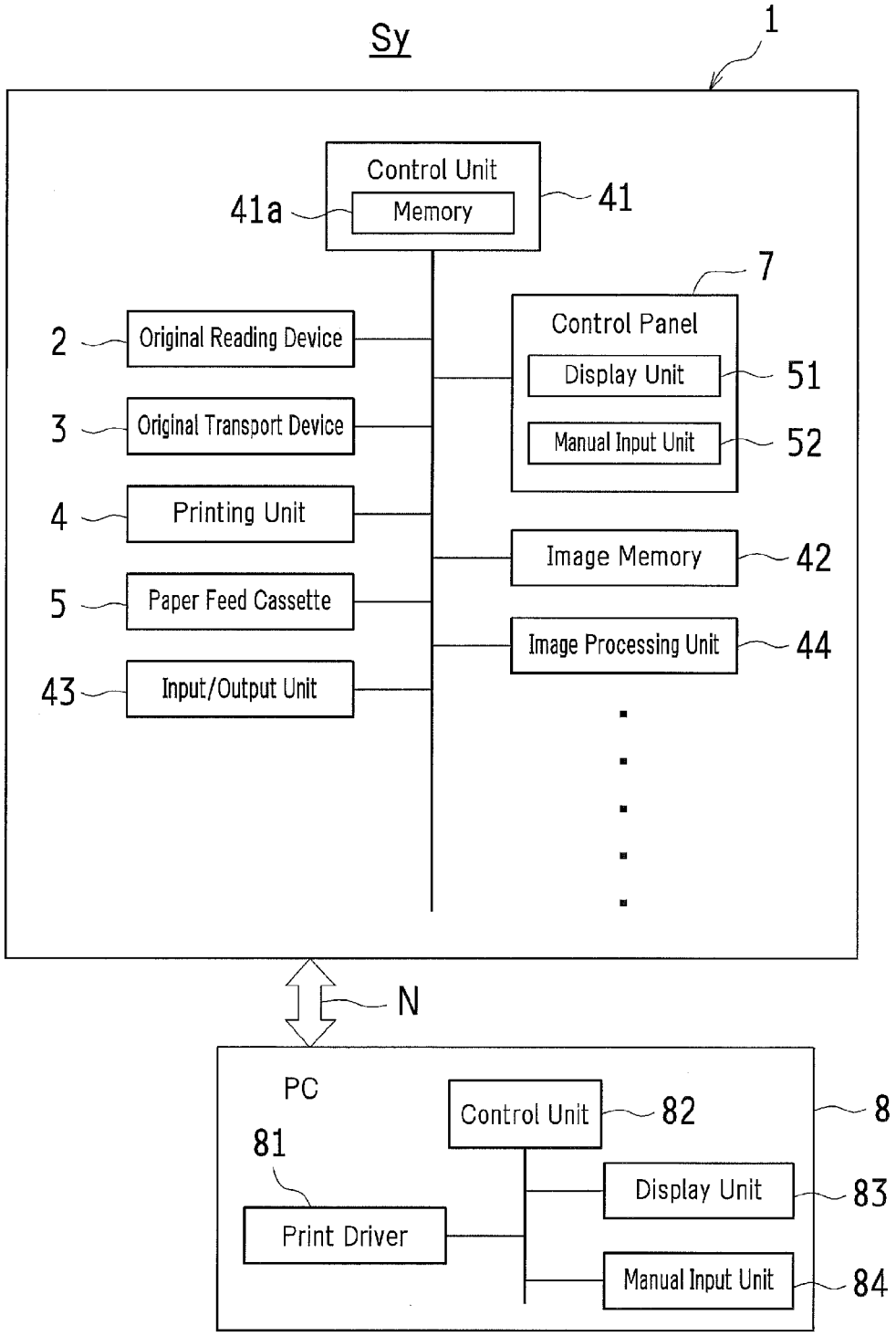
FIG. 12 is a block diagram of the configuration of a control system for an image forming apparatus according to a third embodiment.

FIG. 12 is a block diagram of an image forming system Sy in accordance with the third embodiment. In FIG. 12, the PC 8 includes a print driver 81, a PC control unit 82, a PC display unit 83, and a PC manual input unit (e.g., a keyboard and a mouse) 84. For example, the print driver 81 generates a print job and transmits the print job to the image forming apparatus 1 over a network N. The image forming apparatus 1 receives the print job from the PC 8 through an input/output unit 43 and stores it in an image memory 42, analyzes the print job in the image memory 42 by the control unit 41 or the image processing unit 44, and prints (forms) an image represented by the image data contained in the print job on recording paper on a printing unit 4.

In this context, in the PC 8, through a process that is substantially similar to the process of the first embodiment and involves the control of the print driver 81, the screen display on the PC display unit 83, and the manual input through the PC manual input unit 84, the partial application mode may be selected and, for example, only the second image ga2 for the front side image Ga or only the second image gb2 for the back side image Gb be enlarged/reduced and shifted to generate and transmit a front side image Ga and a back side image Gb to the image forming apparatus 1 as a print job over the network N from the print driver 81.

In addition, in the PC 8, through a process substantially similar to the process of the first embodiment, the full selection mode may be selected and, for example, the entire front side image Ga or the entire back side image Gb be enlarged/reduced and shifted to generate and transmit a front side image Ga and a back side image Gb to the image forming apparatus 1 as a print job over the network N from the print driver 81.

The image forming apparatus 1 receives the print job from the PC 8 through the input/output unit 43 and stores it in the image memory 42, analyzes the print job by the control unit 41 or the image processing unit 44, and prints (forms) either the front side image Ga or the back side image Gb generated in the partial application mode on the front and back sides of recording paper on the printing unit 4 or the front and back side images Ga and Gb generated in the full selection mode on the front and back sides of recording paper on the printing unit 4.

Alternatively, in the PC 8, through a process similar to the process of the second embodiment, the partial application mode may be selected, and only the second image j2 for the adjustment pattern J be enlarged/reduced and shifted for both the front and back sides of the recording paper P to generate and transmit a front side adjustment pattern J and a back side adjustment pattern J to the image forming apparatus 1 as a print job over the network N from the print driver 81.

In addition, in the PC 8, through a process substantially similar to the process of the second embodiment, the full selection mode may be selected, and the entire adjustment pattern J be enlarged/reduced and shifted for both the front and back sides of the recording paper P to generate and transmit a front side adjustment pattern J and a back side adjustment pattern J to the image forming apparatus 1 as a print job over the network N from the print driver 81.

Upon receiving the print job from the PC 8, the image forming apparatus 1 analyzes the print job, prints (forms) either the front side adjustment pattern J and the back side adjustment pattern J generated in the partial application mode on the front and back sides of recording paper on the printing unit 4 or the front side adjustment pattern J and the back side adjustment pattern J generated in the full selection mode on the front and back sides of recording paper on the printing unit 4.

As described above, in the third embodiment, it is on the PC 8 where either the partial application mode or the full selection mode is selected and an enlargement/reduction ratio and an image position are specified for both the front and back sides of the recording paper P. A front side image and a back side image generated in this manner are transmitted as a print job from the PC 8 to the image forming apparatus 1 where the front side image and the back side image are printed (formed) on the front and back sides of the recording paper P. Therefore, the third embodiment achieves the same functions and effects as the first and second embodiments.

Embodiments of the present invention and their exemplary variations have been described so far in reference to the attached drawings. The present invention is however by no means limited to these examples. A person skilled in the art would readily conceive various modification or correction examples without departing from the spirit and scope of the invention.

REFERENCE SIGNS LIST

1 Image Forming Apparatus
2 Original Reading Device
3 Original Transport Device
4 Printing Unit (Image Forming Unit)
5 Paper Feed Cassette
7 Control Panel
8 Personal Computer (PC)
41 Control Unit (Enlargement/reduction ratio Specification Unit, Position specification unit)
42 Image Memory
43 Input/output Unit
44 Image Processing Unit (Image Forming Unit)
51 Display Unit
52 Manual Input Unit
61 Enlargement/reduction ratio Input Unit
71 Position Input Unit
81 Print Driver
82 PC Control Unit
83 PC Display Unit
84 PC Manual Input Unit
N Network
Sy Image Forming System

The invention claimed is:

1. An image forming apparatus that forms a first image in an image region of printing paper and forms a second image in a non-image region of the printing paper that is outside the image region, said image forming apparatus comprising:

an enlargement/reduction ratio specification unit that enables an enlargement/reduction ratio to be specified for the second image; and an image forming unit that forms the first image in the image region of the printing paper without enlarging/reducing the first image and forms the second image and the non-image region on the printing paper after enlarging/reducing the second image and the non-image region by the enlargement/reduction ratio specified through the enlargement/reduction ratio specification unit;

wherein the image forming unit forms the first image in an image region on a first side of the printing paper without enlarging/reducing the first image, forms the second image and the non-image region on the first side after enlarging/reducing the second image and the non-image region by the enlargement/reduction ratio specified through the enlargement/reduction ratio specification unit, and forms the first image and the second image respectively in an image region and a non-image region on a second side of the printing paper without enlarging/reducing the first image and the second image.

2. The image forming apparatus as set forth in claim 1, further comprising a position specification unit that enables a position on the printing paper to be specified for the first image or the second image, wherein the image forming unit forms the first image or the second image at the position specified through the position specification unit.

3. The image forming apparatus as set forth in claim 1, further comprising an operation unit that enables either a first mode in which the first image and the second image are enlarged/reduced or a second mode in which only the second image is enlarged/reduced to be selected, wherein if the first mode is selected through the operation unit, the image forming unit forms the first image and the second image on the printing paper after enlarging/reducing both the first image and the second image by the enlargement/reduction ratio specified through the enlargement/reduction ratio specification unit, and if the second mode is selected through the operation unit, the image forming unit forms the first image in the image region without enlarging/reducing the first image and forms the second image and the non-image region on the printing paper after enlarging/reducing the second image and the non-image region by the enlargement/reduction ratio specified through the enlargement/reduction ratio specification unit.

4. The image forming apparatus as set forth in claim 3, wherein the operation unit includes: an enlargement/reduction ratio input unit that enables an enlargement/reduction ratio to be specified for the first image or the second image and fed to the enlargement/reduction ratio specification unit; and a position input unit that enables a position to be specified for the first image or the second image.

5. The image forming apparatus as set forth in claim 1, wherein the enlargement/reduction ratio specification unit implements a computational process on image data representing the second image to change the enlargement/reduction ratio for the second image.

6. An image forming system, comprising: a terminal device with a print driver; and an image forming apparatus connected to the terminal device over a network, wherein the print driver generates print data representing formation of a first image in an image region of printing paper and formation of a second image in a non-image region of the printing paper that is outside the image region after enlarging/reducing the second image and transmits the print data to the image forming apparatus over the network, and the image forming apparatus, upon receiving the print data, forms the first image in the image region of the printing paper without enlarging/reducing the first image according to the print data and forms the second image and the non-image region on the printing paper after enlarging/reducing the second image and the non-image region according to the print data, wherein the image forming apparatus forms the first image in an image region on a first side of the printing paper without enlarging/reducing the first image, forms the second image and the non-image region on the first side after enlarging/reducing the second image and the non-image region, and forms the first image and the second image respectively in an image region and a non-image region on a second side of the printing paper without enlarging/reducing the first image and the second image.

7. An image forming method that forms a first image in an image region of printing paper and forms a second image in a non-image region of the printing paper that is outside the image region, said image forming method comprising:

an enlargement/reduction ratio specification step of enabling an enlargement/reduction ratio to be specified for the second image; and an image forming step of forming the first image in the image region without enlarging/reducing the first image and forming the second image and the non-image region on the printing paper after enlarging/reducing the second image and the non-image region by the enlargement/reduction ratio specified in the enlargement/reduction ratio specification step;

wherein the image forming step forms the first image in an image region on a first side of the printing paper without enlarging/reducing the first image, forms the second image and the non-image region on the first side after enlarging/reducing the second image and the non-image region by the enlargement/reduction ratio specified in the enlargement/reduction ratio specification step, and forms the first image and the second image respectively in an image region and a non-image region on a second side of the printing paper without enlarging/reducing the first image and the second image.

8. An image forming apparatus that forms a first image in an image region of printing paper and forms a second image in a non-image region of the printing paper that is outside the image region, said image forming apparatus comprising:

an enlargement/reduction ratio specification unit that enables an enlargement/reduction ratio to be specified for the second image;

an image forming unit that forms the first image in the image region of the printing paper without enlarging/reducing the first image and forms the second image and the non-image region on the printing paper after enlarging/reducing the second image and the non-image region by the enlargement/reduction ratio specified through the enlargement/reduction ratio specification unit; and an operation unit that enables either a first mode in which the first image and the second image are enlarged/reduced or a second mode in which only the second image is enlarged/reduced to be selected;

wherein if the first mode is selected through the operation unit, the image forming unit forms the first image and the second image on the printing paper after enlarging/reducing both the first image and the second image by the enlargement/reduction ratio specified through the enlargement/reduction ratio specification unit, and if the second mode is selected through the operation unit, the image forming unit forms the first image in the image region without enlarging/reducing the first image and forms the second image and the non-image region on the printing paper after enlarging/reducing the second image and the non-image region by the enlargement/reduction ratio specified through the enlargement/reduction ratio specification unit.

9. The image forming apparatus as set forth in claim 8, further comprising a position specification unit that enables a position on the printing paper to be specified for the first image or the second image, wherein the image forming unit forms the first image or the second image at the position specified through the position specification unit.

10. The image forming apparatus as set forth in claim 8, wherein the operation unit includes: an enlargement/reduction ratio input unit that enables an enlargement/reduction ratio to be specified for the first image or the second image and fed to the enlargement/reduction ratio specification unit; and a position input unit that enables a position to be specified for the first image or the second image.

11. The image forming apparatus as set forth in claim 8, wherein the enlargement/reduction ratio specification unit implements a computational process on image data representing the second image to change the enlargement/reduction ratio for the second image.

* * * * *